US005913352A

United States Patent [19]

Scates et al.

[11] Patent Number: 5,913,352

[45] Date of Patent: Jun. 22, 1999

[54] HINGE AND IMPROVED HINGE AND PANEL SURFACE GEOMETRY OF A MULTI-PANEL DOOR ASSEMBLY

[75] Inventors: John E. Scates, Denton, Tex.; Gregory D. Robertson; Bruce N. Bates, both of Little Rock, Ark.

[73] Assignee: Windsor Door, Inc., Little Rock, Ark.

[21] Appl. No.: 08/914,110

[22] Filed: Aug. 19, 1997

Related U.S. Application Data

[60] Provisional application No. 60/024,164, Aug. 19, 1996.

[51] Int. Cl.[6] ..... E05D 15/10

[52] U.S. Cl. ..... 160/229.1

[58] Field of Search ..... 160/229.1, 201, 160/232, 207, 40

[56] References Cited

U.S. PATENT DOCUMENTS

| | | | |
|---|---|---|---|
| 2,968,829 | 1/1961 | Meddick . | |
| 3,608,613 | 9/1971 | Halliwell | 160/229.1 |
| 3,891,021 | 6/1975 | Geoffrey | 160/201 X |
| 4,736,785 | 4/1988 | Seuster . | |
| 4,893,666 | 1/1990 | Hörmann . | |
| 4,930,561 | 6/1990 | Clay . | |
| 4,989,660 | 2/1991 | Wagner . | |
| 5,002,114 | 3/1991 | Hörmann . | |
| 5,148,850 | 9/1992 | Urbanick . | |
| 5,163,493 | 11/1992 | Kraeutler . | |
| 5,170,832 | 12/1992 | Wagner . | |
| 5,404,927 | 4/1995 | Bailey . | |
| 5,445,206 | 8/1995 | Shepard . | |
| 5,495,640 | 3/1996 | Mullet et al. . | |
| 5,509,457 | 4/1996 | Jellá . | |
| 5,522,446 | 6/1996 | Mullet et al. . | |
| 5,669,431 | 9/1997 | Druzynski et al. | 160/229.1 |

FOREIGN PATENT DOCUMENTS

| | | |
|---|---|---|
| 464822 | 6/1991 | Sweden . |
| 502420 | 10/1995 | Sweden . |

*Primary Examiner*—David M. Purol

*Attorney, Agent, or Firm*—Kennedy Covington Lobdell & Hickman, LLP

[57] ABSTRACT

A mating assembly for sectional doors includes matable end portions formed on door sections with a first concave portion configured to accept a second convex portion with the concave portion and the convex portion having different curvature radii, the end portions being joined for relative movement by a pinned hinge member with the hinge pin having a series of lateral projections and the hinge member having stop members to engage the lateral projections to prevent hinge pin rotation.

22 Claims, 17 Drawing Sheets

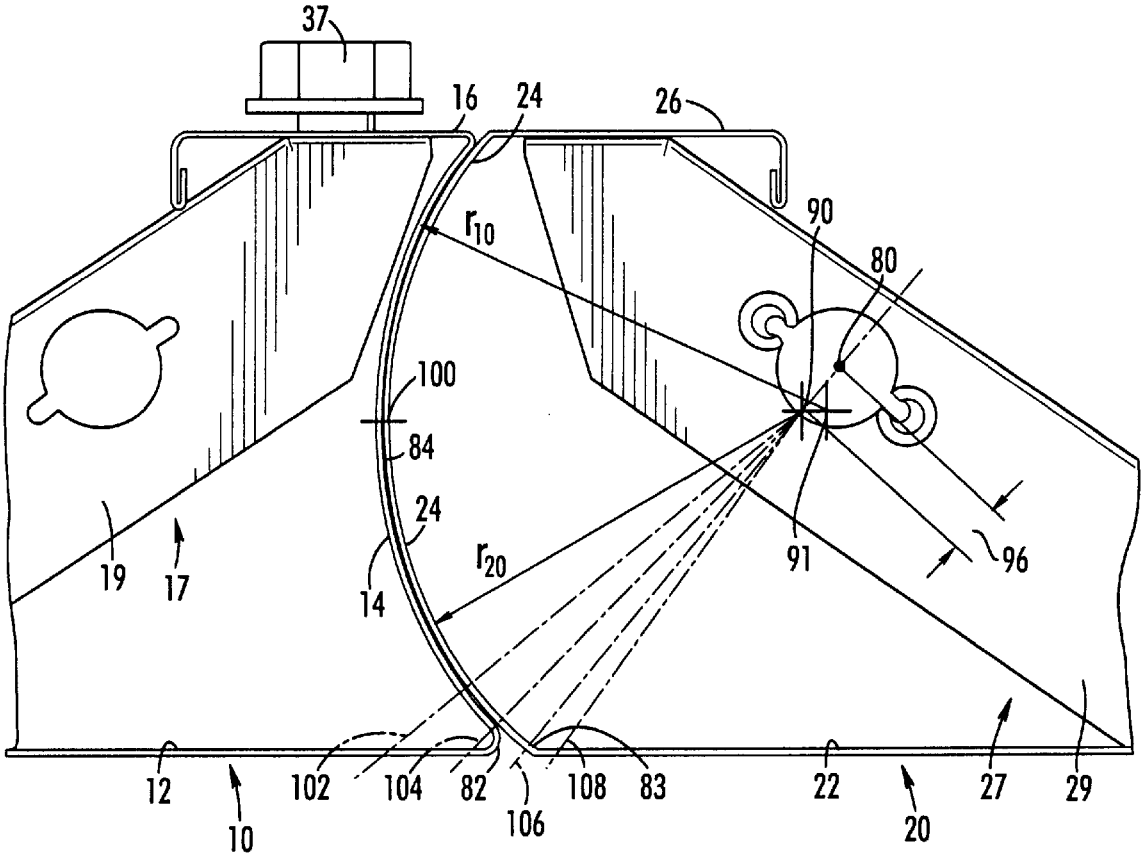
FIG. 14
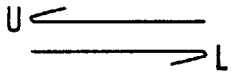

HINGE AND IMPROVED HINGE AND PANEL SURFACE GEOMETRY OF A MULTI-PANEL DOOR ASSEMBLY

This application claims the benefit of U.S. Provisional Application No. 60/024,164, filed on Aug. 19, 1996.

BACKGROUND OF THE INVENTION

The present invention relates broadly to vertically opening doors which are formed from a plurality of panel assemblies. More particularly, the present invention relates to a mating assembly for two panels associated with vertically opening doors.

Vertically opening paneled doors are typically used for garage doors, truck doors and other applications where large doors are required which would be too heavy and awkward to swing open. These paneled doors are confined to a predetermined track of movement by outrigger-type rollers which are fitted into tracks which curve from a vertically oriented position to a horizontally oriented position. The doors may be manually operated but it is becoming more popular to have a form of motor drive to automatically open and close the doors. Since the doors are formed with panels which allow relative movement therebetween, the doors may move smoothly through the 90° transition in a compact space.

There have been many attempts to provide effective junctions between door panels which provide a sufficient seal to keep the weather out while allowing the upper panel to fold away from the panel directly below during the transit of the 90° between the vertical, lowered position and the horizontal, raised position. Further, it is desirable to provide a minimal opening between the panels as this transition occurs so that fingers or other key elements are not pinched therebetween during either opening or closing of the garage doors. In Mullet et al U.S. Pat. No. 5,522,446, the pinching problem is addressed, along with the problems associated with achieving a workable solution. There, Mullet et al state:

> Numerous problems, however, have been encountered in the application of an internal barrier configuration to overhead door panels. In some instances, intricate configurations are employed which may tend to cause very stringent fabrication requirements or unduly precise installation procedures. Any deficiencies in these respects normally result in door panels which minimally interfere or bind to a sufficient extent to cause highly undesirable drag in the movement of the door. In some instances, the contoured panel edges may be configured, such that it is difficult or impossible to effect the attachment of hinges at a sufficiently reinforced surface or at locations where the pivot axis of the hinges is optimally located. In other instances, the edge configurations make sealing against water and air filtration (sic) extremely difficult, if not impossible. Another problem with the use of contoured edges is that in many instances it is difficult to achieve a rapid separation of the interfitting surfaces as soon as an angularity between the panel commences to preclude the introduction of undesirable drag forces. To Applicants' knowledge, no internal barrier configuration has fully satisfied all these various competing requirements. (Col. 3, 11. 1–21).

The present invention provides a solution.

SUMMARY OF THE INVENTION

It is accordingly an object of the present invention to provide a garage door mating assembly which provides ease of assembly in combination with a structural relationship minimizing the danger of pinching fingers or other objects between the panels at the junction.

It is another object of the present invention to provide such a door panel mating assembly with an adequate weather seal while still providing smooth operation.

It is yet another object of the present invention to provide such a door panel mating assembly which provides more efficient use of materials to feature a lower weight door than is available in the prior art.

To that end, the present invention provides a unique combination of door panel structure and associated hinges to provide a unique junction therebetween. A bracket is mounted to elongate bracing and support members, called "stiles," which are in turn mounted to the door panels in order to bridge the gap therebetween. Finally, an easily insertable pin is provided for maintaining the bracket attachment to the stile and allowing the door panels to rotate with respect to one another.

According to the preferred embodiment, the present invention includes a door panel mating assembly for use in a multi-panel door configured for movement between a generally vertical lowered positioned and a generally horizontal raised position with the panels being connected closely adjacent to one another and movable relative to one another to allow the door to follow a curved track to move from the vertical lowered position to the horizontal raised position without projecting from a doorway in which the door is disposed, the mating assembly including a plurality of panel ends formed integrally with the panels, the panel ends including a first panel end formed with a concave surface having a first radius of curvature and being formed integrally with the first of the plurality of panels and a second panel end formed with a convex surface having a second radius of curvature, with the second radius of curvature being less than the first radius of curvature, and with the first radius of curvature and the second radius of curvature intersecting at a contact point, not sharing a common center of curvature, the second panel end formed integrally with a second of the plurality of panels and disposed adjacent the first panel and for fitment of the convex surface adjacent the concave surface for movement of the surfaces relative to one another and to define a junction therebetween, and a hinge member extending across the junction and having two end portions with a first end portion mounted to the first panel and a second end portion pivotably mounted to the second panel for pivoting movement about a pivot axis with the pivot axis being the origin of a coordinate plane having coordinate axes defining four quadrants, with the center of the convex curvature point being in the third quadrant. Preferably, the second panel includes a front face and the convex surface joins the front face at a bend point, with the pivot axis lying along a imaginary line from the bend point through the center of convex curvature. It is further preferred that a plurality of the panels be formed with a first end portion at one end thereof, and a second end portion formed at an opposing end thereof for mating a plurality of panels in a sequential array. Preferably, the first end portions are formed at a lower end of the panels and the second end portions are formed at upper ends of the panels relative to a vertically disposed door.

The panels themselves are formed from a thin metal, typically steel which is 0.02 inches thick. These panels form the front face of the door and are typically in alignment when the door is closed. A junction exists therebetween. Along the lower surface of the panels, which defines and will be referred to herein generally as an "upper panel," a concave surface is formed with a first radius of curvature. The upper surface of the panel directly below, i.e., a "lower panel," is formed as a convex surface with a second radius of curvature different from the first radius of curvature. A flange projects outwardly from the inner end of each of the curved portions and projects in opposite directions therefrom. When the panels are in a mated condition, a small line of contact exists between the convex and concave surfaces. Therefore, assembly can be accomplished with the upper panel resting on the lower panel.

A plurality of stiles are arranged along the panels. The stiles are formed from generally U-shaped metal with a typical thickness of 0.035 inches with the open portion of the "U" mounted toward the door panels. The stiles project upwardly at an approximately 35° angle from the panel adjacent the area near the curved panel ends with an outer projecting surface of the stile fitted under the flange associated with the panel. Typically, the stiles are positioned at each side edge of the door itself and are repeated intermittently laterally thereacross as necessary for bracing. Further, stiles from upper panels are preferably mounted in alignment with the stiles from lower panels.

It is preferred that the hinge member be mounted to a first hinge support member, or stile, fixed to the first panel into a second panel hinge support member, or stile, fixed to the second panel using a hinge pin. It is preferred that the second panel hinge support member be formed as a channel having two opposing side walls projecting outwardly from a spanning section with the side walls being separated by a spacing and each of the side walls having an aperture formed therein coincident with the pivot axis, with the hinge member being formed with two outwardly projecting mounting walls with each of the mounting walls having an opening formed therein for fitment of the hinge member to the hinge support member, with the mounting walls adjacent the side walls, and the openings in registry with the apertures, and the hinge pin projecting through the openings in the apertures. The hinge members themselves are formed from a single piece of sheet metal while providing vertical, parallel mounting wall members that project downwardly for a greater distance than the distance separating the two side walls when bent into an upright position. This is accomplished by directing the farthest projecting mounting walls outwardly away from one another and then providing a double fold in the metal which causes the mounting walls to stand upright. The brackets themselves are bolted to the upper stiles and then pinned to the lower stiles for relative motion therebetween. The brackets are mounted on each stile and provide a support for both the roller and themselves with respect to the lower door panel and provide the necessary rotational motion track for the curved surfaces associated with each panel.

The hinge pin is preferably formed with a plurality of tabs projecting outwardly from a cylindrical surface thereof at a predetermined circumferential spacing, with the side walls being formed with a plurality of notches sized to allow passage of the tabs therethrough and disposed at a predetermined circumferential spacing adjacent the apertures, with the spacing corresponding to the spacing of the tabs and the mounting walls are formed with a plurality of notches sized to allow passage of the tabs therethrough and disposed with a predetermined circumferential spacing adjacent the openings with the spacing corresponding to the spacing of the tabs for passing the hinge pin through the openings in the apertures with the tabs passing through the notches. Preferably, the mounting walls are formed with an annular flange projecting outwardly therefrom in registry with the openings, with the notches being formed in the flange. It is preferred that the notches on the flange be formed at a disposition wherein the notches are in registry with the notches formed on the side walls when the hinge member is at a position apart from a position wherein the hinge member is mounted to the first and second panels, and the first and second panels are in alignment. The slots, or notches, in the stiles are formed at a position to be in registry with the slots formed in the brackets when the brackets are oriented 90° away from a position wherein the associated door panels are closed and aligned. This is the maximum extreme orientation allowed by the brackets and must occur when the panels are being assembled. During operation of the panels, the bracket does not attain 90° but, on the other hand, is subject to approximately a 70° maximum operational rotational displacement.

It should be understood that the bracket rotational angle is made with reference to the plane of the door panels, which is vertical when the door is closed.

Preferably, the tabs are formed as pairs adjacent either end of the hinge pin as outer tabs and a hinge pin is formed with at least one pair of inner tabs projecting outwardly from the cylindrical surface thereof at a predetermined circumferential spacing and at a predetermined position along the length of the hinge pin, with the outer tabs intermediate the inner tabs and ends of the hinge pin, and at least one of the side walls is formed with a tab retainer projecting from a inner surface thereof adjacent the aperture formed in the side wall, with the tab retainer having a slot open to the aperture formed therein and sized for purchase of one of the inner tabs, with the inner tabs being positioned along the longitudinal length of the hinge pin for disposition of at least one of the inner tabs with at least one slot to prevent rotation of the hinge pin during relative motion between the panels. Preferably, a pair of tab retainers are oppositely disposed across each aperture in each side wall and the hinge pin is formed with two pair of inner tabs with each tab being sized and disposed along the longitudinal length of the hinge pin for purchase by one of the tab retainers to prevent rotation of the hinge pin during relative motion between the panels.

The hinge pins are formed as metal cylinders having a flat end surface and a curved outer, cylindrical surface. A plurality of tabs is formed therein. This includes two oppositely disposed, generally flat members projecting outwardly from the cylindrical surface of the pin. A pair of outer tabs is formed in the pin at either end thereof, near the flat, end surface. One or more pairs of inner tabs are formed in general alignment with the outer tabs at a position on the pin therebetween. It should be understood that the inner tab functions may be performed by any number of tabs extending between the outer tab pairs.

The tab retainer is formed in the stile by pressing a small portion inwardly about the hinge. The tab retainers act in concert with the inner tabs to hold the pin against rotation during door movement. This allows the designer to designate a wear surface and provide therefor. Further, sawing action attributable to hinge pin motion is eliminated. In sum, the buttons perform essentially four functions. First, they assist in aligning the hinge pin with the hole for insertion of the hinge pin. Second, they act to lock the pin from rotation as described above. Third, looser tolerance and, consequently, easier insertion may be built into the pin and stile due to the offset surfaces. Finally, an increased contact area between the pin and the stile is created. This is significant when dealing with thin sheet metal parts.

The hinge structure includes a unique geometry involving the relationship between the brackets, stiles, the pivot point, or rotational center and the curvature of the panels.

To maintain the no-pinch outer surface of the door, the outer corner of the upper panel where the panel curves into the concave shape is maintained at a minimum distance from the curvature of the immediately lower panel. In order to maintain the no-pinch function, this gap must be minimized at all times during relative panel movement.

When the panels are aligned, the highest point on the top of the lower panel will be in contact with the innermost concave point of the upper panel. In this manner, a seal is provided. In addition, the contact surface provides support for the upper panel during installation of the hinge. Nevertheless, during operation, the contact area must be rapidly broken by quickly moving the panels away from one another. This will minimize scrubbing and friction.

It should also be noted that the door must undergo a minor amount of backbending. Due to the curvature of the roller track associated with garage doors, the top panel roller is positioned at a slight rearward lean with respect to the remaining panels when the door is closed. This results in the panels undergoing a backbend when the door is raised and rests horizontally on the upper reaches of the track. The backbend is typically around 5°. To allow for this, without binding, the inner corner of the convexly curved upper panel is positioned a predetermined distance away from the corresponding point on the lower panel, created by the radius of curvature of the concave surface being slightly greater than the radius of curvature of the convex surface.

In order to maintain all these relationships during door operation, it is necessary to define and locate a pivot point, or rotational center of the bracket joining the door panels. The pivot point is chosen to be offset from the centers of curvature of the panels and a line projecting directly away from the joint at the external surface of the two door panels. As previously stated, the concave surface of the upper panel has a different radius of curvature from the convex surface of the lower panel with the upper panel having a greater curvature radius. This maintains the separation at the inner surface to allow for backbending of the panels. Further, in order to move the door panels away from one another rapidly, the pivot point is moved in a direction toward the direction of rotation of the panels. Therefore, separation occurs rapidly. Further, the gap at the outer corner of the upper panel is continually minimized throughout the motion of the door. It should be noted that the upper, concave surface can also be formed with two separate radii which meet at the contact area. This construction could also result in operation similar to the preferred embodiment of the present invention.

BRIEF DESCRIPTION OF THE DRAWINGS

FIG. 14 is a side view of the door panels with the bracket removed;

DETAILED DESCRIPTION OF THE PREFERRED EMBODIMENT

Figure 1:
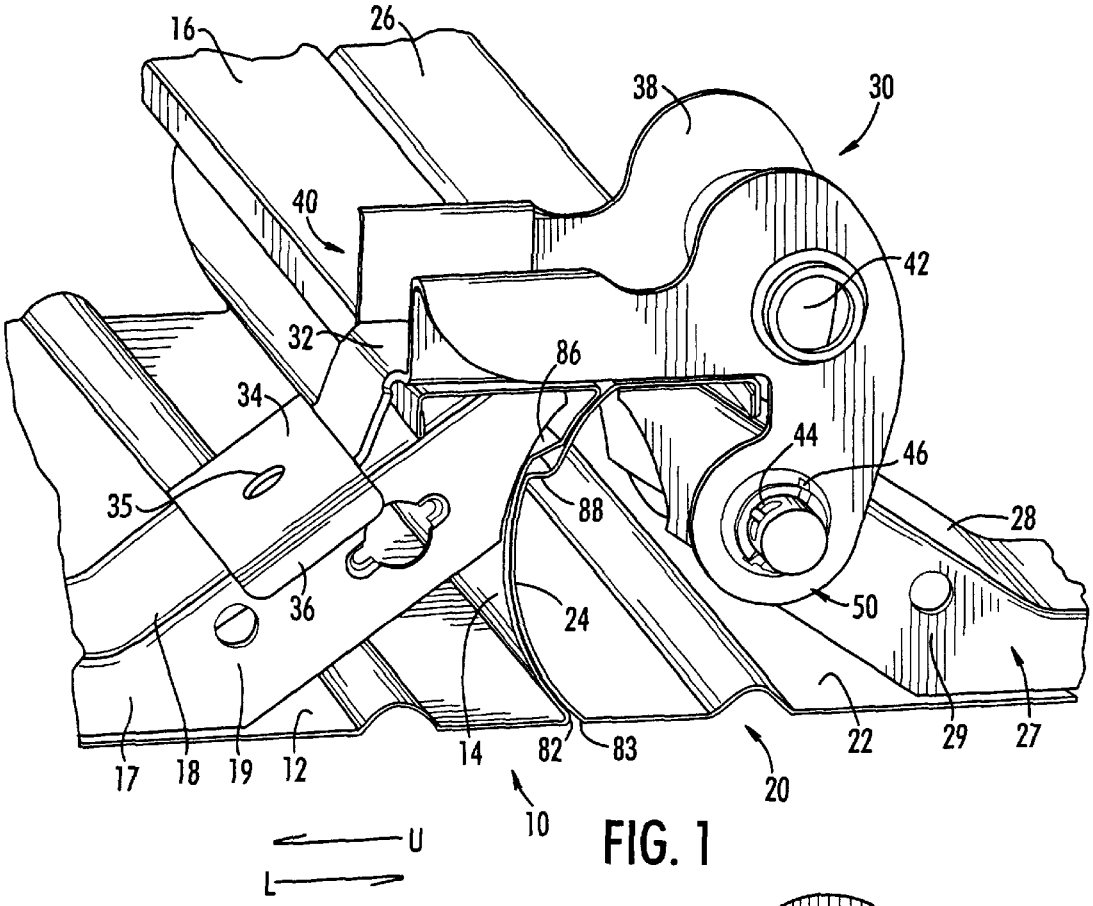
FIG. 1 is a perspective view of a door panel mating assembly according to the preferred embodiment of the present invention.
Figure 2:
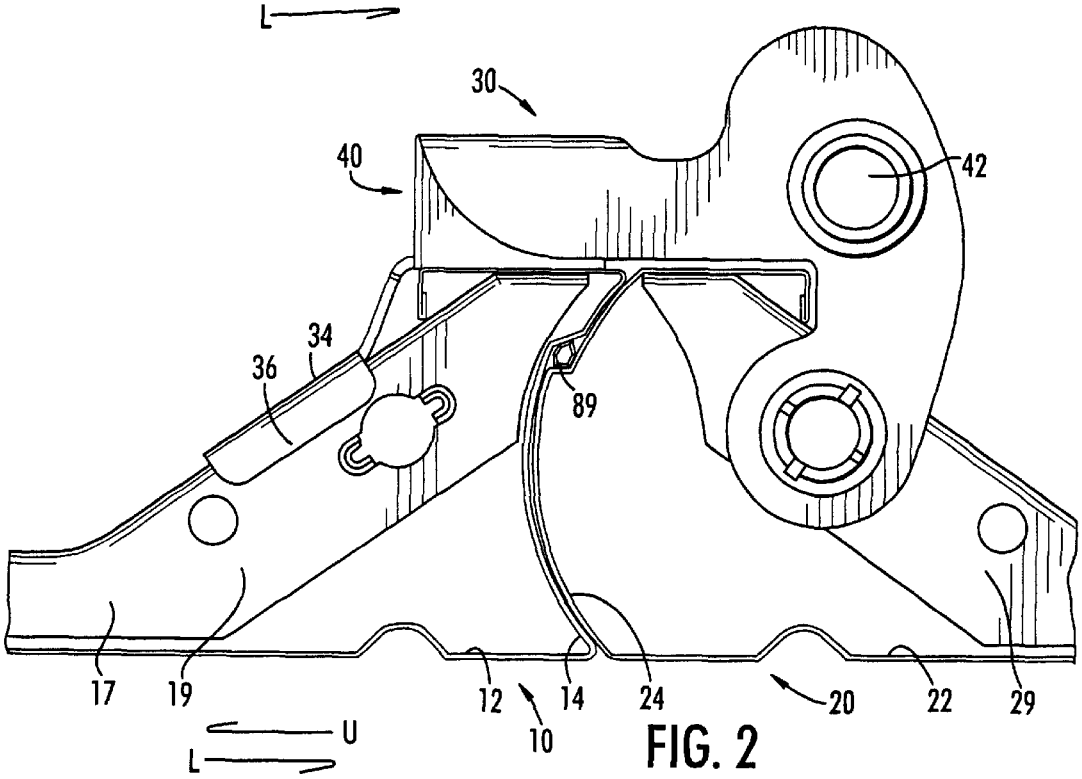
FIG. 2 is a side view of the door panel mating assembly illustrated in FIG. 1.

Turning now to the drawings and, more particularly, to FIGS. 1 and 2, a door panel mating assembly is illustrated and includes an upper door panel 10 and a lower door panel 20 which are formed from sheet steel which may be 0.02 inches thick. Due to the orientation of the drawings in FIGS. 1 and 2, arrows U,L are used to further clarify the terms "upper" and "lower." The upper panel 10 is formed with a generally flat face 12 with a panel end portion 14 formed into a concave curvature with a first radius of curvature and defining an outer corner 82. A second panel 20 is formed from a similar sheet of steel to include a flat face member 22 and a curved end portion 24 having a convex curvature. The second panel curved end portion 24 is formed with a second radius of curvature which is less than the radius of curvature of the upper panel end portion 14. It should be noted that while the convex and concave surfaces are presented as smooth curves, these surfaces can be approximated with multiple straight-line segments without departing from the spirit and scope of the present invention. The panels 10,20 are configured for mating and contact one another at a single contact line which will be discussed in greater detail hereinafter. The panels also include inner corners at the inner portions of the curvatures 14,24 which form inner, parallelly oriented flanges 16,26 projecting away from one another.

A plurality of stiles 17,27 are attached to each of the upper and lower panels. The stiles 17,27 are formed as generally U-shaped members with a generally horizontal surface 18 with two outwardly projecting vertical surfaces 19 to define the "U". The channels are inverted and mounted to the panels in generally parallel alignment with one stile at each end and additional stiles positioned along the lateral extent of the panel as necessary for stability. The stiles 17 of the upper panels 10 are mounted in direct opposition to the stiles 27 of the lower panel 20. The end portions of the stiles are fitted underneath the flanges 16,26 of the panels 10,20 for reasons which will be explained in greater detail hereinafter.

A unique bracket 30 is provided and is shown in FIGS. 1 and 2 mounted to the stiles. The bracket 30 is preferably formed from a single piece of sheet metal which may be 0.035 inches thick. This piece of metal is stamped into the necessary shape and then bent into the ultimate configuration. Initially, a generally flat base portion 32 includes an angularly oriented upper stile contact member 34 projecting directly outwardly therefrom and angled downwardly for contact with the upper stile 17. The stile contact member 34 is bent into a generally U-shaped configuration for mating with the upper stile 17 to reduce side-to-side movement. A bolt opening 35 is formed in the stile contact member 34 to bolt the bracket to the stile 17.

A pair of vertically oriented support members 38 project upwardly from the base 32 of the bracket 30 and extend downwardly over the lower panel 20. A so-called double fold 40 is used to allow the bracket to be formed from a single piece of metal. As may be seen in FIGS. 1 and 2, the support members 38 are generally J-shaped with the curvature of the "J" pointing toward the face of the door. Since a radius of curvature associated with the "J" is greater than the distance between the support members 38, the support members 38 must be formed with the "J-curves" projecting away from one another, then bent upwardly into a facing relationship and then bent through 180° to achieve the ultimate relationship seen in the figures and resulting in the double fold 40. Openings are provided in the support members including openings 42 for the track rollers (not shown) and openings 44 for the hinge pins. The bracket 30 is bolted to the upper stile 17 and is rotatably fixed to the lower stile using hinge pins as seen in FIG. 2.

Figure 3:
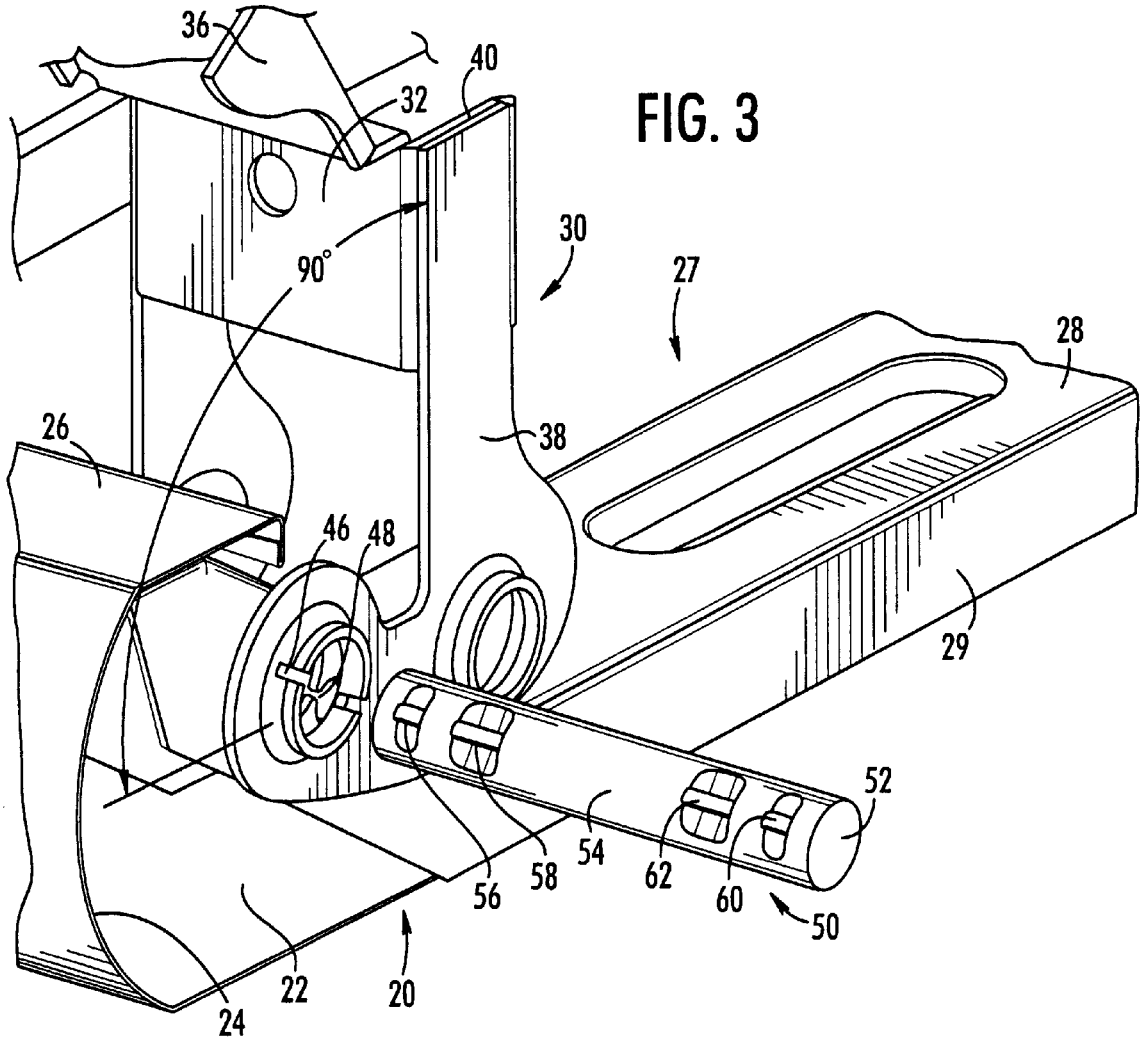
FIG. 3 is a perspective view of the lower door panel illustrated in FIG. 1 with the hinge pin exploded away from the bracket with the bracket in an assembly position.
Figure 4:
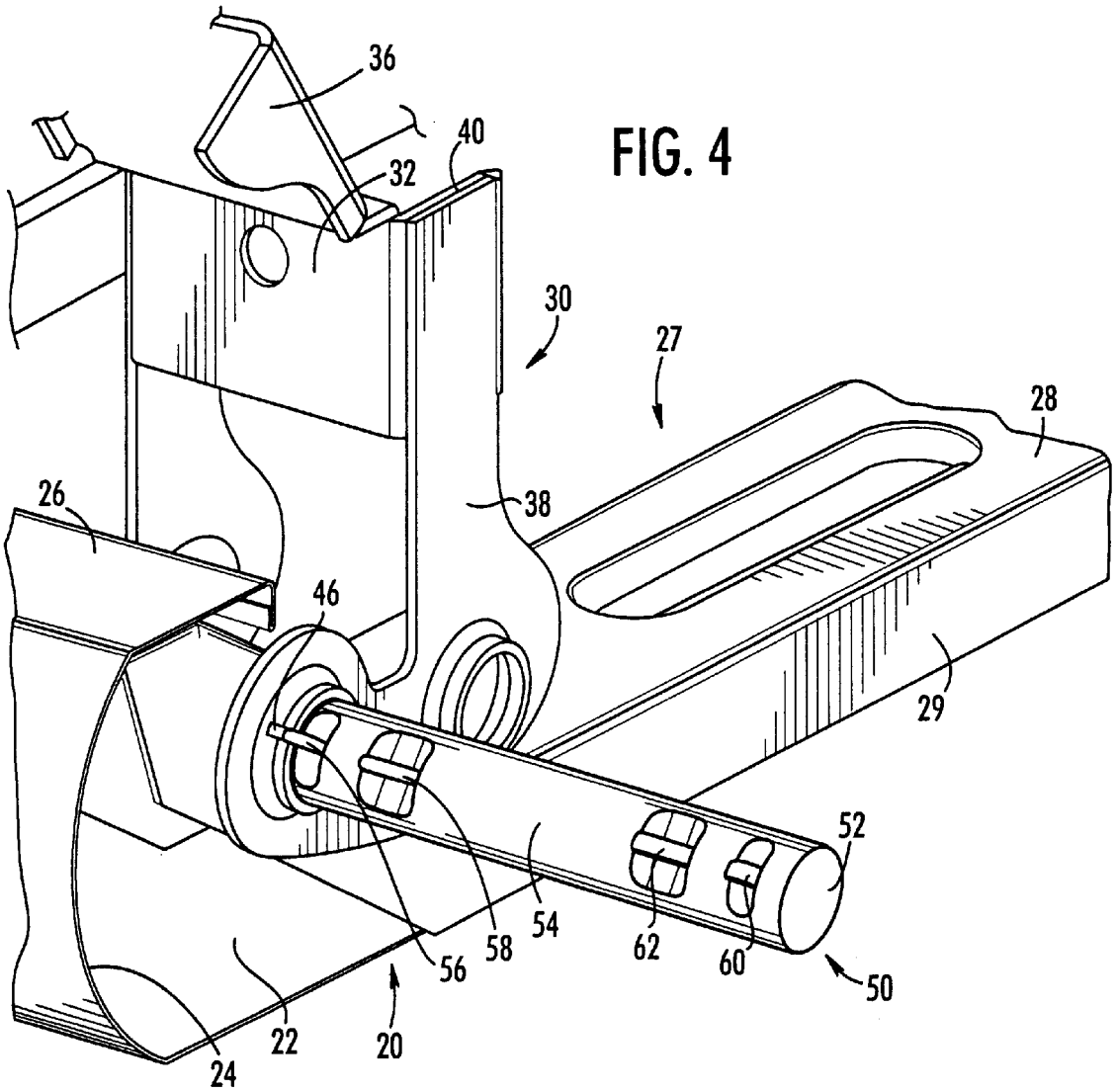
FIG. 4 is a perspective view of the door panel illustrated in FIG. 3 with the hinge pin beginning entry into the bracket opening.
Figure 5:
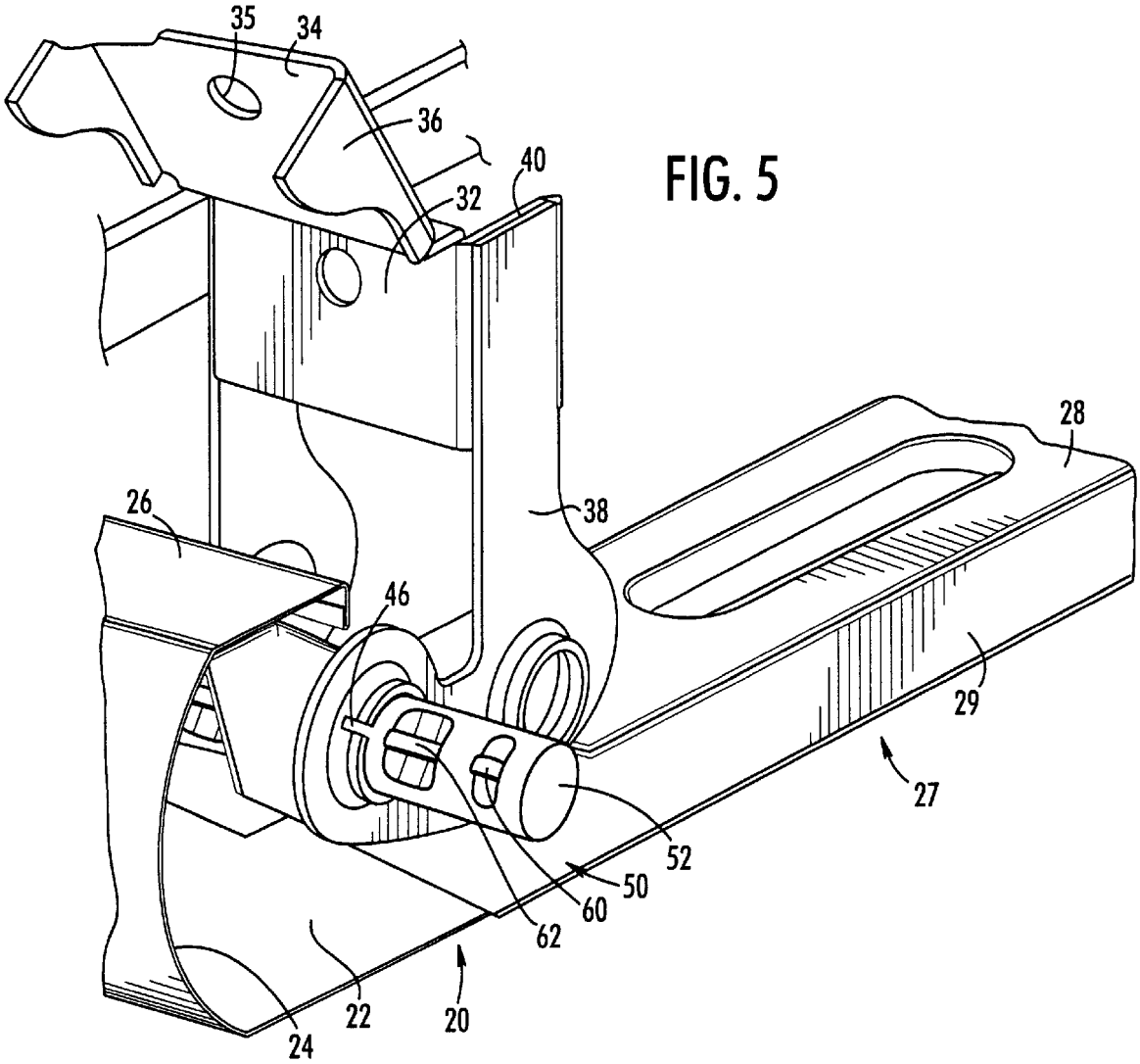
FIG. 5 is a perspective view of the door panel illustrated in FIG. 4 with the hinge pin approximately three-quarters of the way into the opening.
Figure 6:
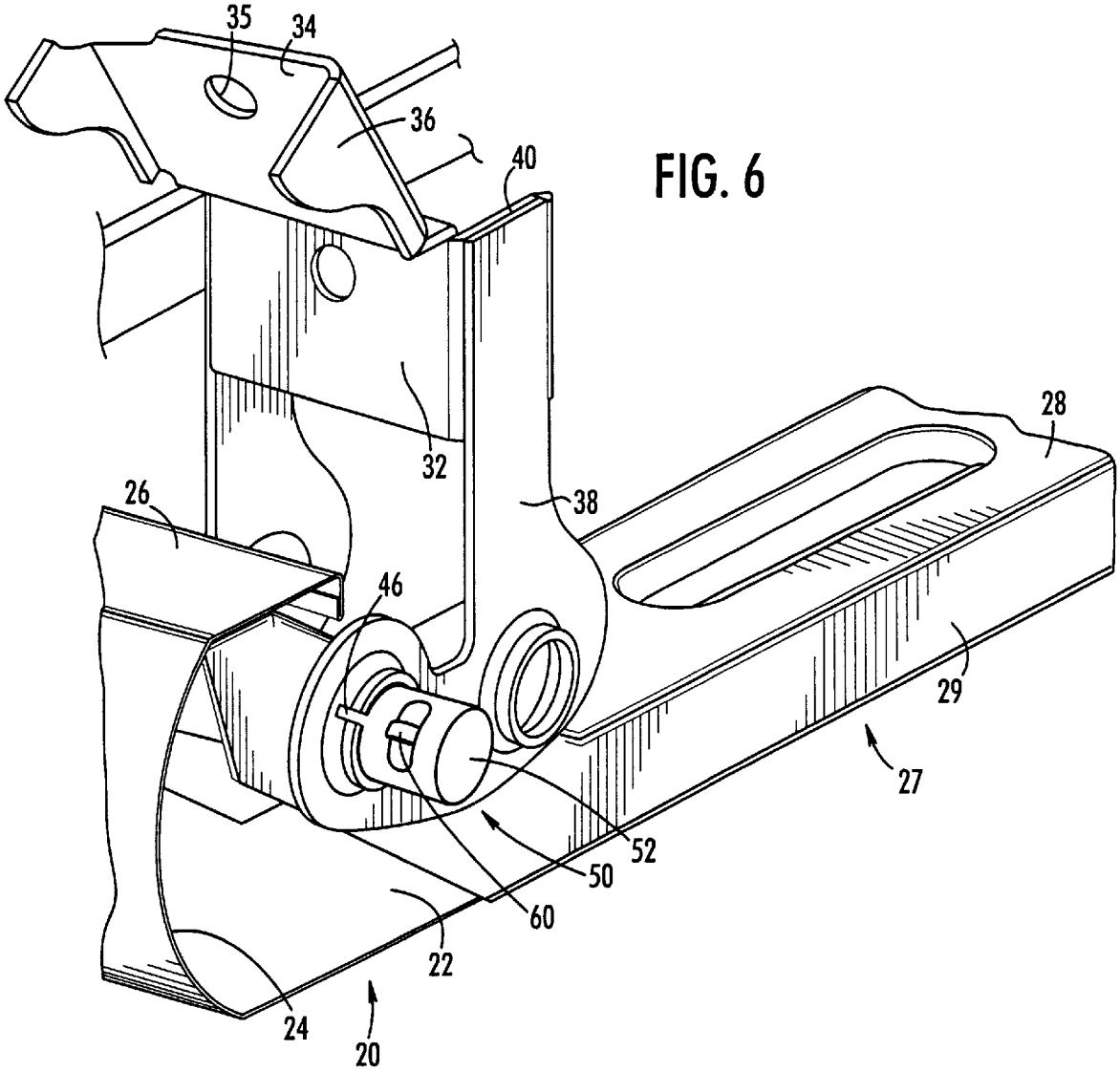
FIG. 6 is a perspective view of the door panel illustrated in FIG. 5 with the hinge pin at approximately 80 percent insertion.
Figure 7:
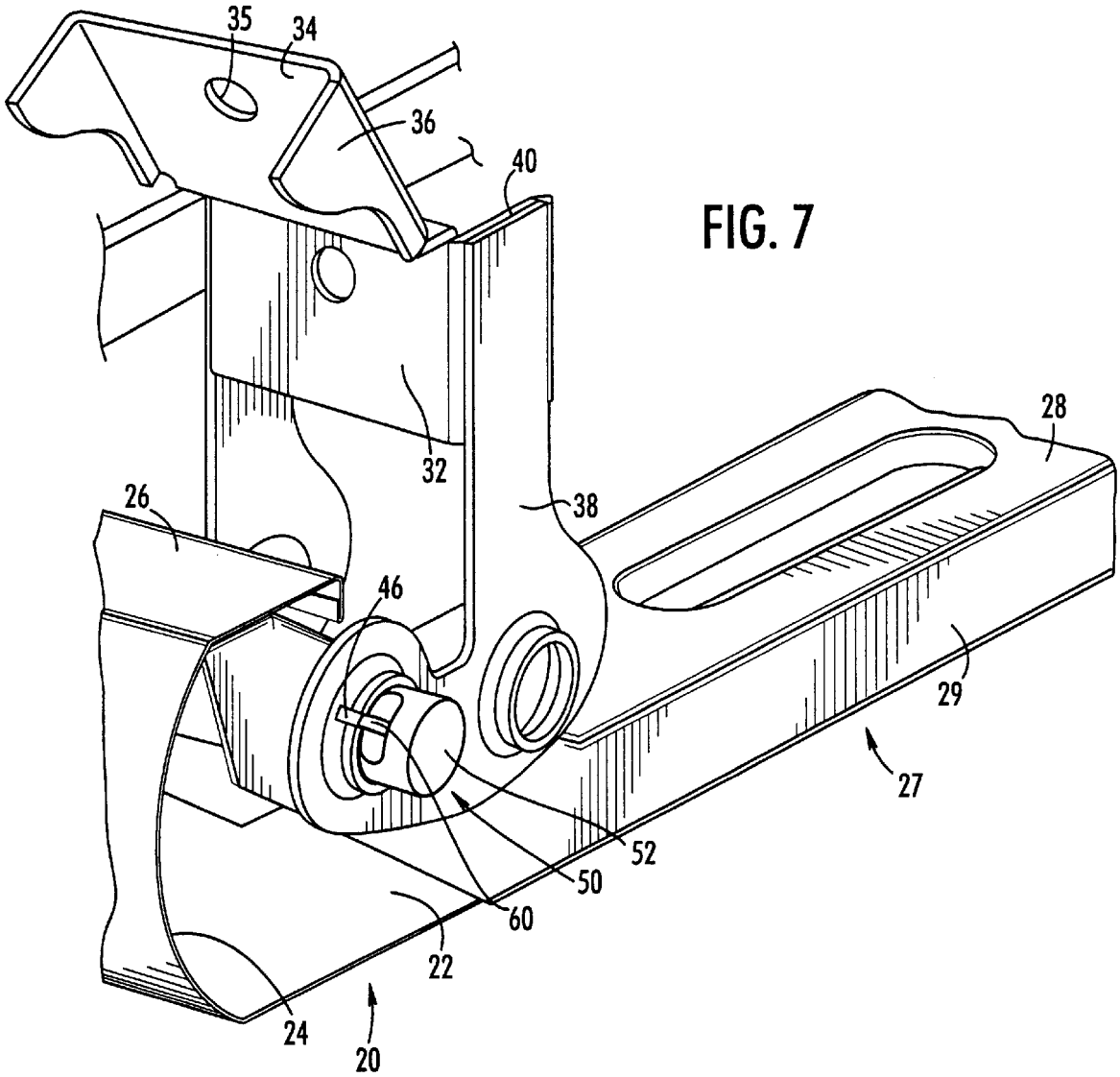
FIG. 7 is a perspective view of the door panel illustrated in FIG. 6 with the hinge pin fully inserted and the bracket in an assembly position.
Figure 13:
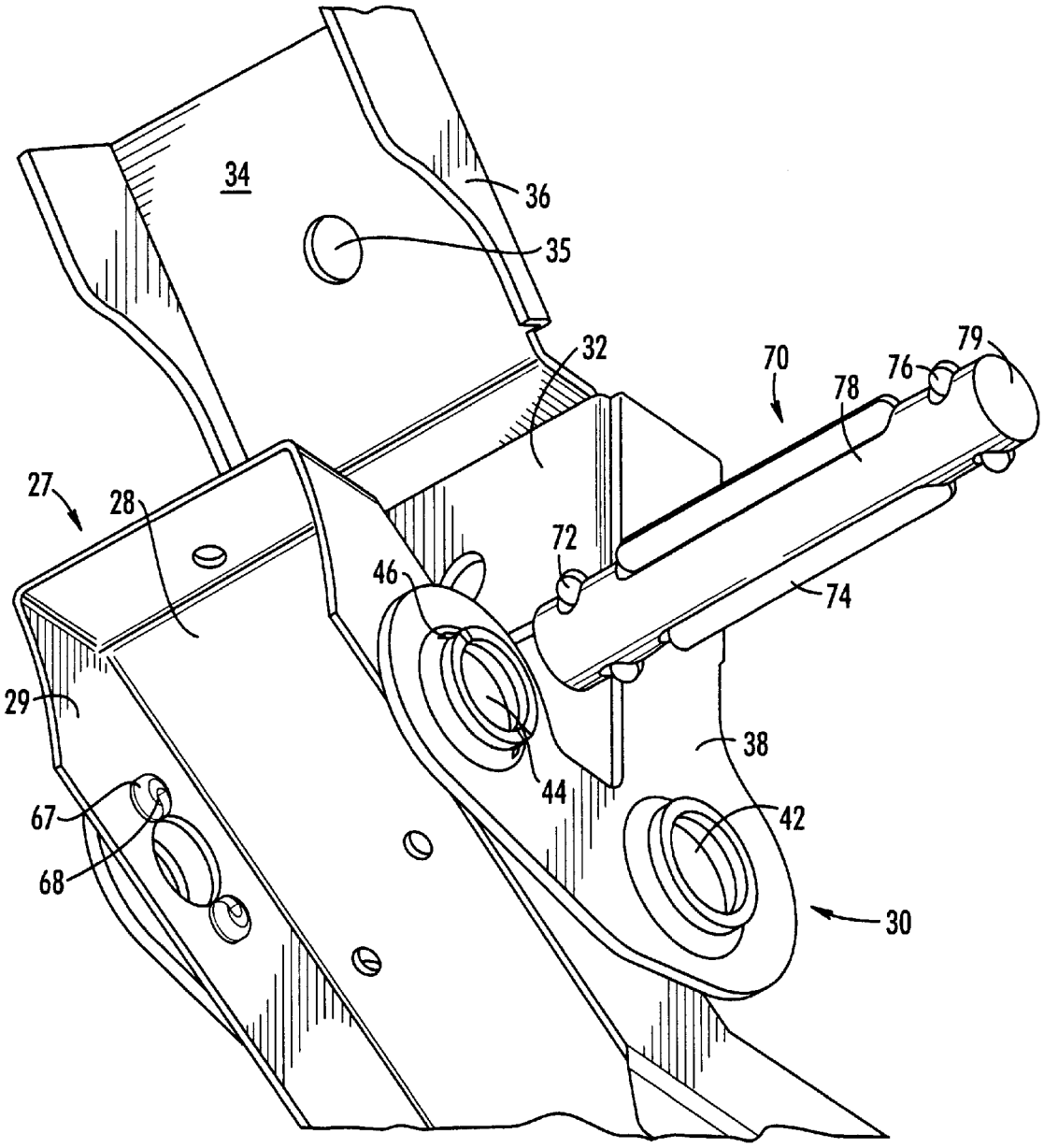
FIG. 13 is an underside perspective view of a bracket and stile with an alternate embodiment of the hinge pin.

Turning now to FIG. 3, a hinge pin 50 is shown in position for assembly. The hinge pin 50 is primarily a cylindrical, solid or hollow metal member having a plurality of aligned, oppositely disposed tabs projecting outwardly therefrom in pairs. Two outer tab pairs 56,60 are disposed adjacent the end surfaces 52 of the hinge pin 50 and project outwardly from the cylindrical surface 54 thereof. Inner tabs 58,62 are provided closer to the center of the hinge pin 50 and intermediate the outer tabs 56,60. It should be noted that these inner tabs 58,62 may be formed as one single pair of tabs or any number of tab pairs extending intermediate the outer tabs 56,60 to achieve the same function as is provided herein. FIG. 13 illustrates an alternate embodiment of the hinge pin illustrated generally at 70 including a cylindrical surface 78 and an end surface 79. Outer tabs 72,76 are disposed adjacent the end surfaces 79 of the alternate hinge pin 70. A pair of elongate tabs 74 extends outwardly from a position intermediate the outer tabs 72,76. The criteria for the inner tabs includes the ability to engage slots formed in the vertical walls 19,29 of the stiles 17,27.

A unique slot arrangement is provided for association with the tabs on the hinge pins 50,70 for assembly of the door panels. With the bracket in the assembly position of 90°, slots 46 formed in walls forming the hinge pin bracket openings 44 are aligned with similar slots 48 formed adjacent openings 48 in the stiles 27 so that the hinge pin 50 may pass through unobstructed. Once past the outer slots, the hinge pin may be continually inserted as seen in FIGS. 4–7.

Figure 8:
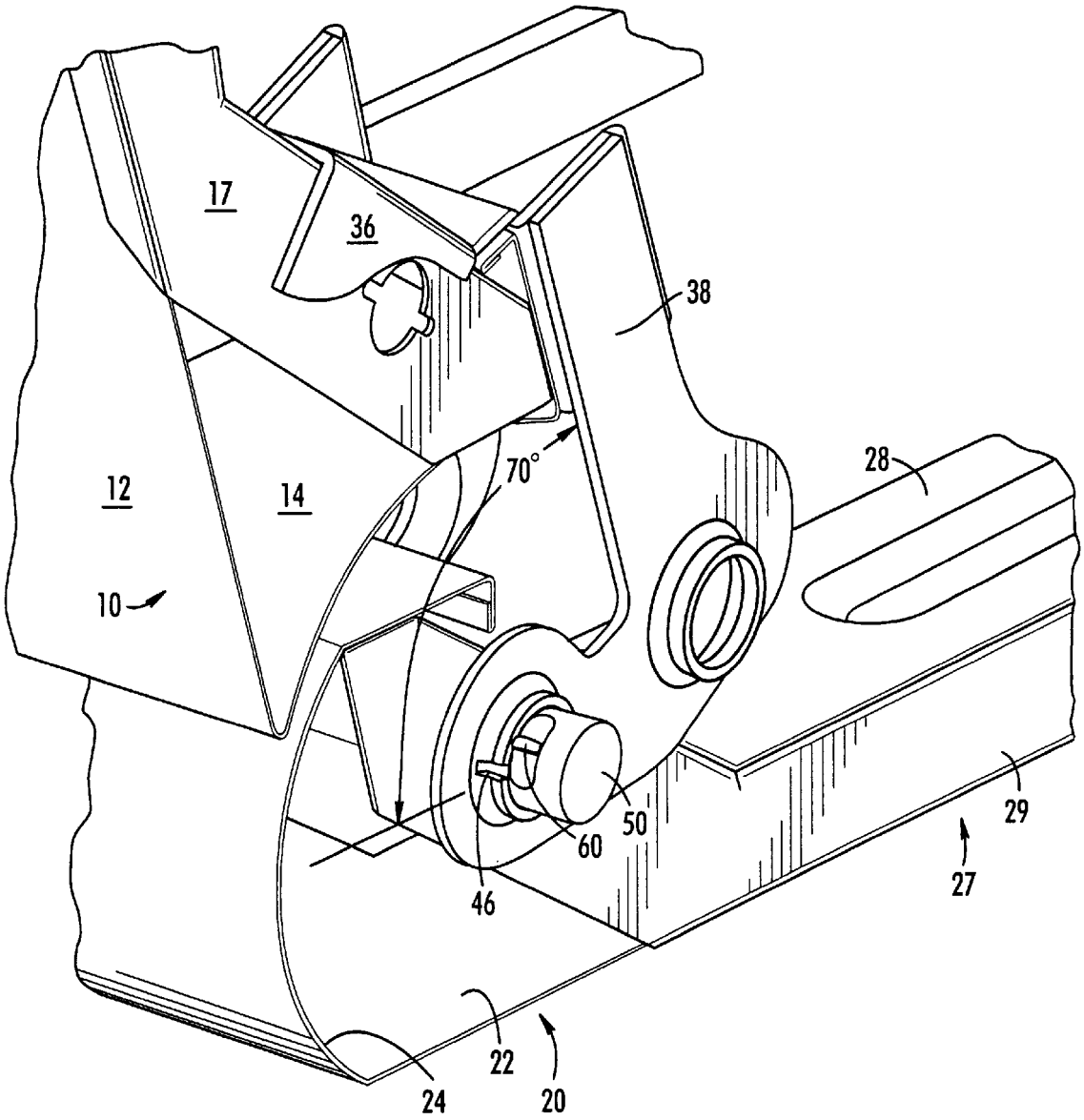
FIG. 8 is a perspective view of the door panel illustrated in FIG. 7 with the hinge pin fully inserted and the door panels at the maximum operational angle.
Figure 12:
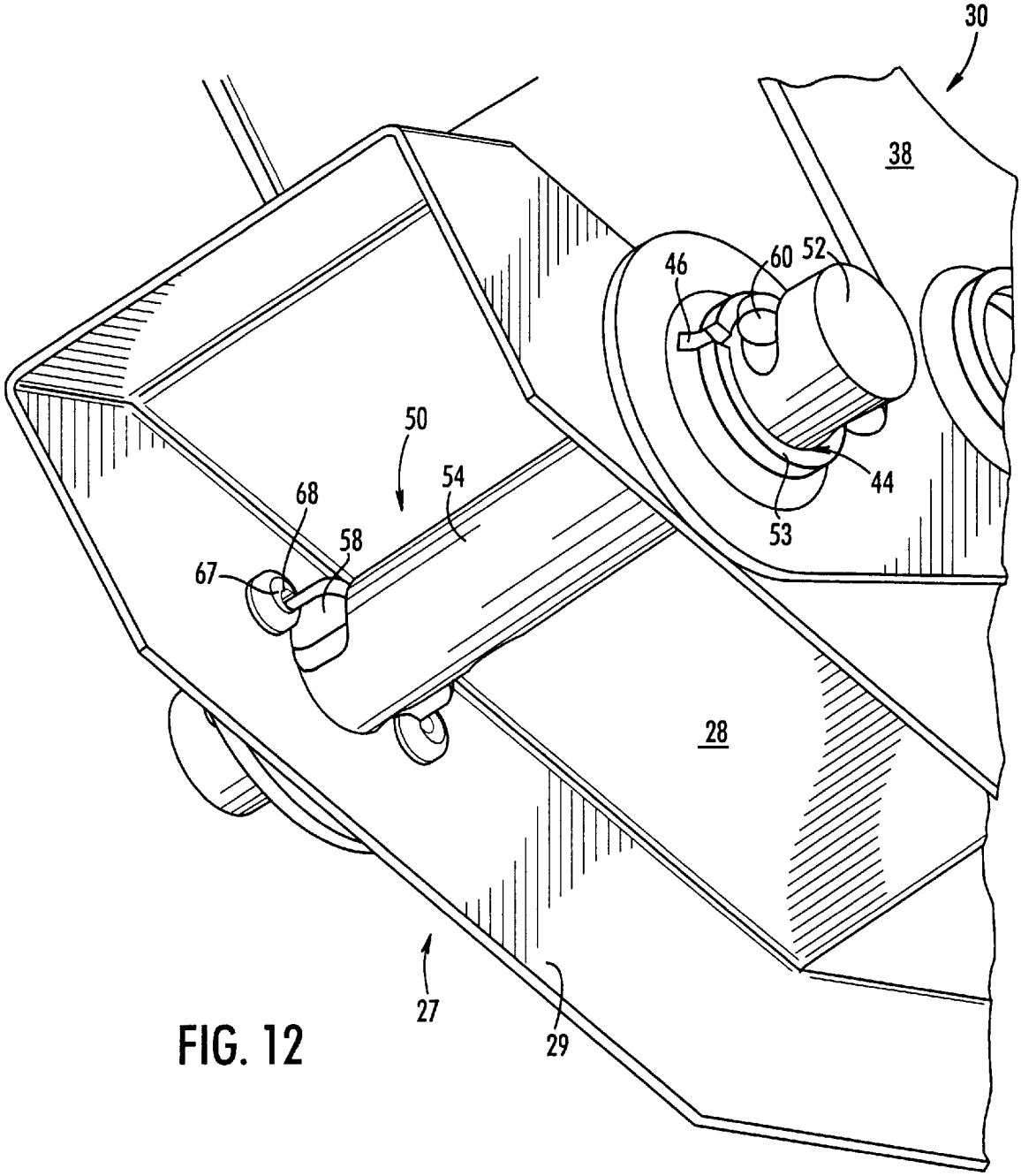
FIG. 12 is a perspective underside view of the stile and bracket with the hinge pin fully inserted with the bracket at the maximum operational angle.

As seen in FIGS. 8 and 12, with the hinge pin 50 fully inserted, the inner tabs 58,62 remain engaged with the slots 48,68 in the stiles while the outer tabs 56,60 are unengaged with the slots 46 in the bracket openings. Once the bracket 30 is rotated at an inclination of 70° or less which coincides with the maximum extent of the range of movement during operation, the bracket slots 46 are no longer in registry with the outer tabs 56,60 such that the hinge pin 50 remains locked into position, its rotation being prevented by the inner tabs 58,62 in abutment with the stile 27 and lateral movement being prevented by the abutment of the bracket 30 against the outer tabs 56,60. It should be noted that a rivet or other pivotal fastener can be used in place of the hinge pin. Further, the hinge pin function can be provided by extruding the second hinge support member and the hinge member in a pivotal manner.

Figure 9:
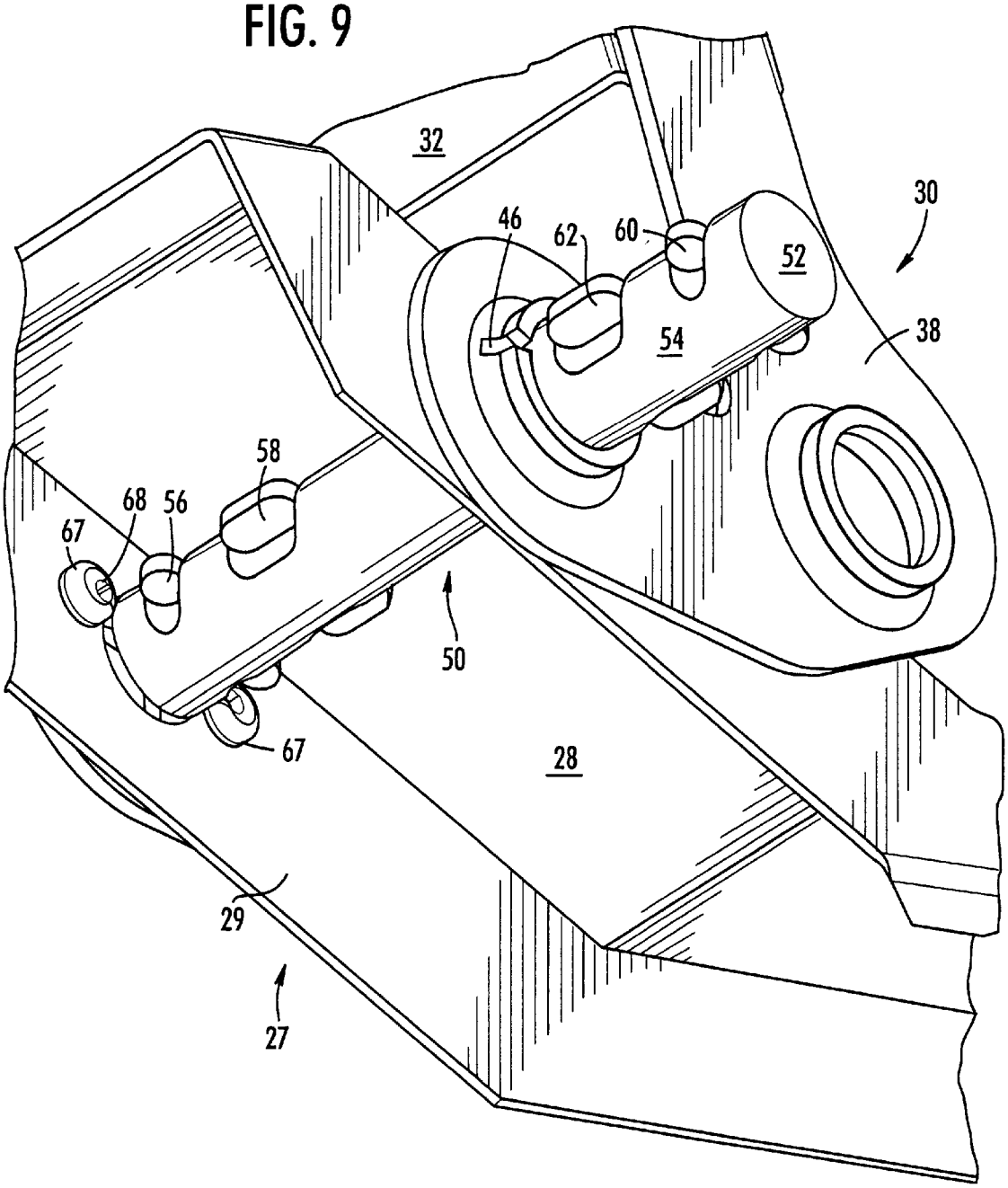
FIG. 9 is a perspective underside view of the stile and bracket illustrating the hinge pin being initially inserted and showing the button guiding the pin into the hole.
Figure 10:
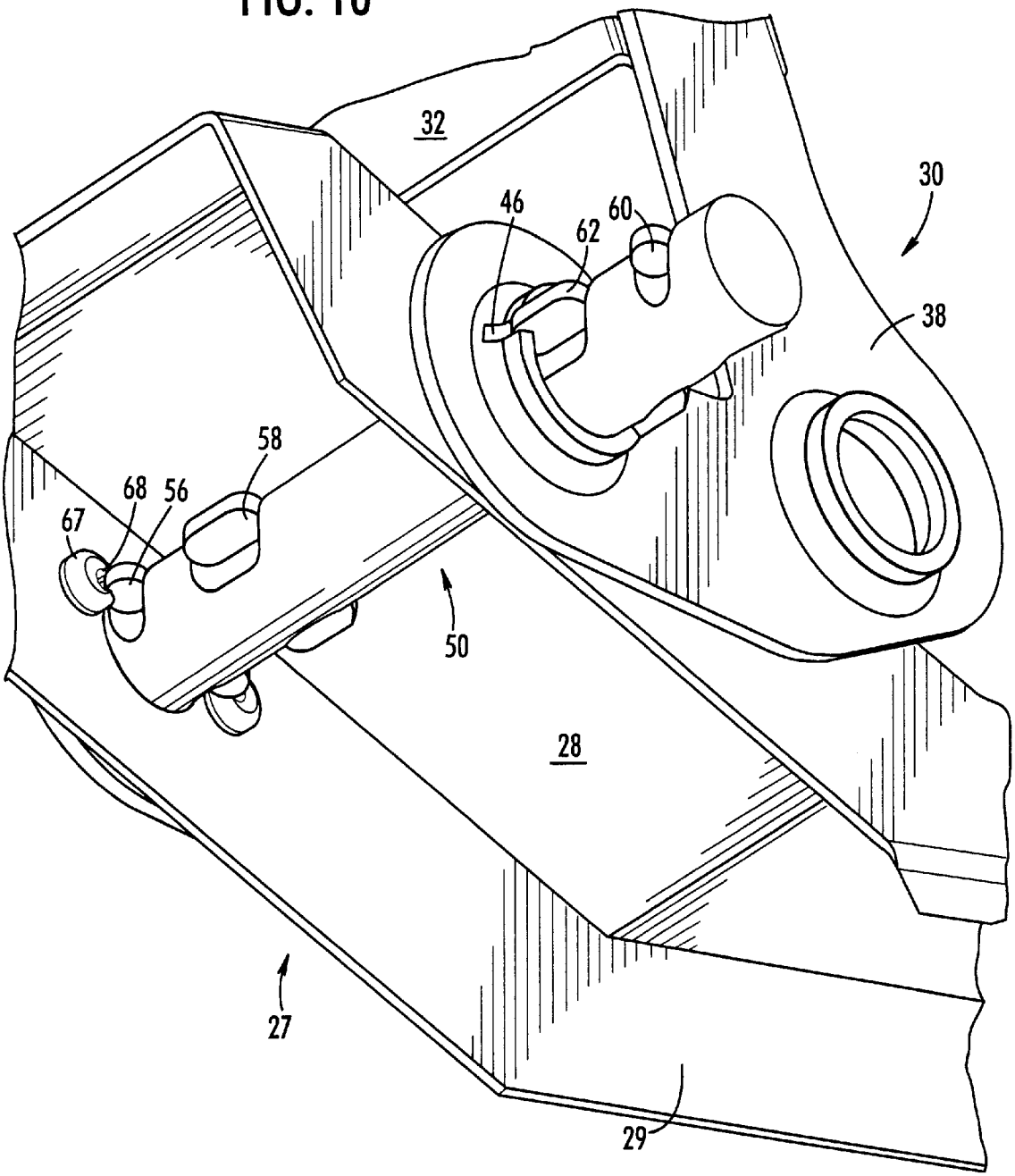
FIG. 10 is a perspective underside view of the stile and bracket illustrated in FIG. 9 with the hinge pin engaging the directing tab retainers.
Figure 11:
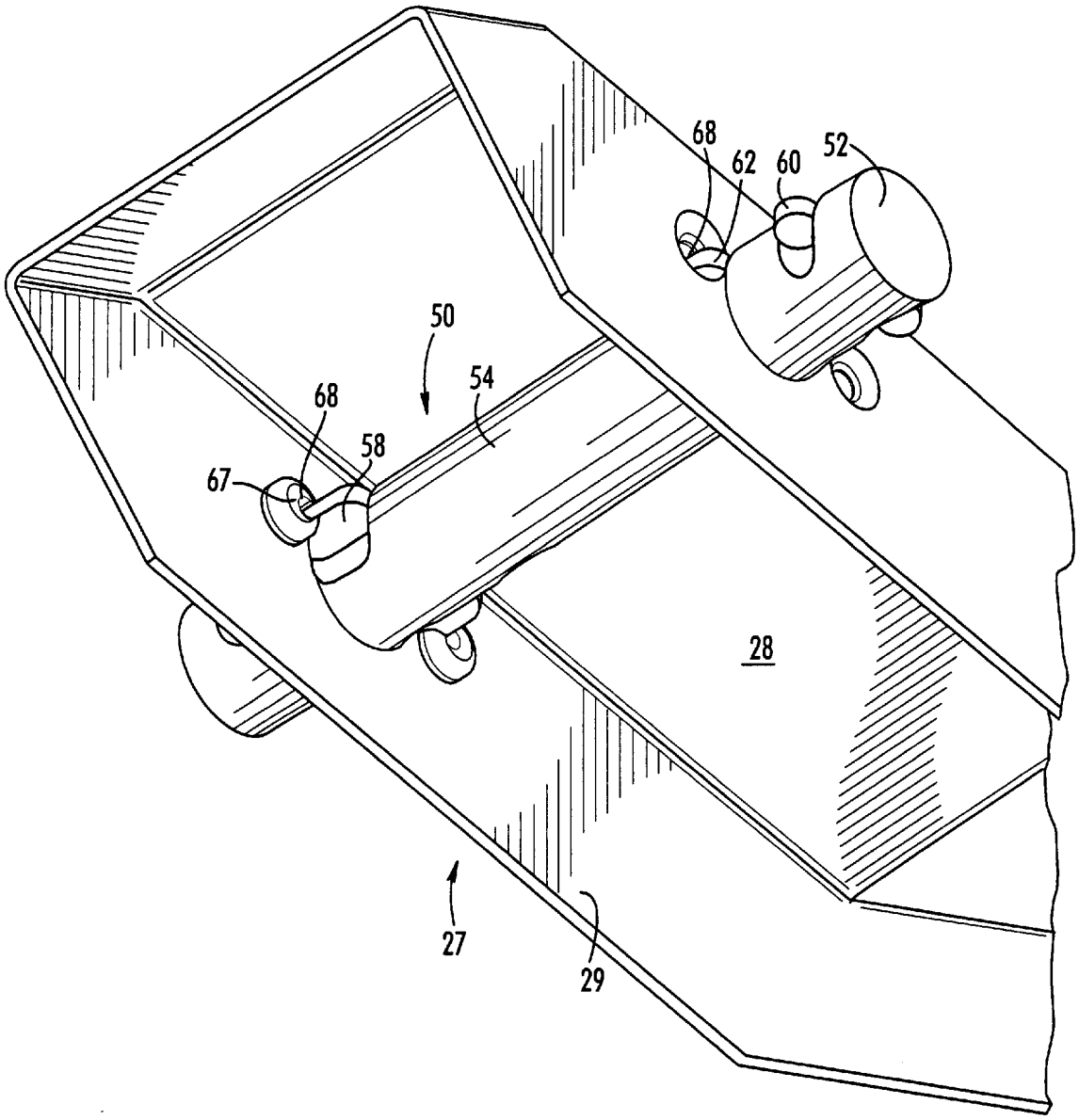
FIG. 11 is a perspective underside view of the stile with the hinge pin fully inserted and locked into place with the bracket omitted for clarity.

Ease of assembly is enhanced by using the hinge pins 50,70. As seen in FIG. 9, "buttons" or projections 67 are formed in the inner surface of the stile 27 having slots 68 formed therein for engagement with the tabs 56,58,60,62. The buttons are stamped into the stiles 17,27 such that the metal is deformed into forming the buttons. As the pin 50 is being inserted, aligning the pin with the hole in the stile 27 on the far side wall 29 can be difficult. The buttons 67 tend to push the pin back toward the center of the hole as it is manipulated during insertion. The buttons also provide additional contact area between the pin tabs 56,62 and the stile 27 to reduce contact stresses produced by rotational loads. Furthermore, moving the contact surface 68 away from the stile surface 29 reduces the critical distance tolerance between the pin tabs 58,56 by increasing the separation of the locking surfaces on the stile 67 and bracket 53. Alternately, the entire ring surface of the hole may be deformed with a technique known as "coining" but this technique removes one of the key features of the buttons, that of providing an alignment locating function for inserting the hinge pins by "feel" rather than by visual alignment. The insertion of the hinge pin 50 is seen from this perspective in FIGS. 9–12. In FIGS. 9 and 10, the first outer tabs 56 engage slots 68 formed in the buttons 67 while the second inner tabs 62 engage slots formed in the bracket 30 which are in registry with slots formed in the stile 27. As the hinge pin 50 is fully inserted as seen in FIG. 11, which omits the bracket 30 for clarity, the inner tabs 58,62 are engaged with slots 68 formed in the buttons 67. This operational location will prevent rotation of the hinge pin 50 during door panel movement. This allows the designation of a wear surface, i.e., the extruded portion of the walls forming the opening 44 in the brackets U, and prevents any relative movement between the stile 27 and the hinge pin 50 to prevent sawing action therebetween and damage. FIG. 12 inserts the bracket 30 at an operational position which is at a 70° or less inclination thereby removing the slots 46 from registry with the slots 48 in the stiles 27. As can be seen, the outer tab 60 is in abutment with the walls forming the bracket opening 44 to prevent lateral movement. This prevents the bracket 30 from flaring and causing damage in that manner.

A unique feature of the door panel mating assembly of the present invention is that it provides a weather seal offering minimum scrubbing or friction during movement and the panels fit closely enough together throughout movement so as to prevent pinching of fingers or other objects between the door panels during movement. The no-pinch feature finds a practical definition in the idea of keeping the outer corner 82 of the upper panel 10 no more than a predetermined maximum distance away from the curved surface 24 of the lower panel 20, thereby keeping the predetermined gap 84 at a minimum, as illustrated in FIGS. 14–21, with additional reference to FIG. 1. In addition, in a modification of the preferred embodiment of the present invention as shown in FIGS. 1 and 2 the first panel end portion 14 includes a bend 86 in the concave surface, and the second panel end portion 24 includes a bend 88, with both bends being toward the second panel 20 and spaced a predetermined distance apart. There, bends 86,88 define a gap, with a sealing element 89 being disposed within the gap to extend the width of the panels 10,20 for additional sealing. Another feature of the mating assembly is the ability of the door to undergo backbending without considerable interference. This is accomplished by providing the upper, concave surface 14 with a first radius of curvature and the lower, convex surface 24 with a second radius of curvature with the first, upper radius of curvature being greater than the second, lower radius of curvature. The difference is slight, on the order of 0.040 inches. Nevertheless, this is enough to maintain sufficient "slop" or "play" in the door panel boundary. The door panels 10,20 come into contact at a contact point 100 which is in line with the two curvature radii, the center of each being slightly offset in a generally vertical orientation as seen at 90 and 91 in FIG. 14. Point 90 is the center of curvature for the lower panel 20 while point 91 is the center of curvature for the upper panel 10. The pivot point or center of a curve defined by the rotational motion of the upper door panel relative to the lower panel is defined at 80 and is a predetermined distance 96 away from the center of curvature 90 of lower panel 20.

For best operation, a line through the rotational point 80 and the center of curvature 90 should intersect the panels 10,20 between the outer corner of the upper panel 82 and the outer corner of the lower panel 83 defined by lines 104 and 106 in FIG. 14. Within this range, the panels 10,20 are at their closest contact point when the door is in a closed and upright position. As the top section rotates back, it will lift off of the lower section, rapidly breaking the contact point 100 and providing no further contact throughout motion. If the rotational center 80 were positioned such that a line through the rotational center 80 and the center of curvature 90 extended through line 102 in FIG. 14, the optimum range would then be exceeded and the panels 10,20 would scrub as the top section rotated away from the bottom section. If the pivot point were moved toward the curved surface 24, such that a line through the rotational center 80 and the center of curvature 90 extended through line 108 in FIG. 14, excessive interference during backbending could result. Basically, the amount of separation attained during rotation is determined by the distance 96 between the rotational center 80 and the center of curvature 90. If this distance is too small, rubbing could be excessive and, if the distance is too large, the so-called no-pinch feature would have its effectiveness reduced.

Figure 15:
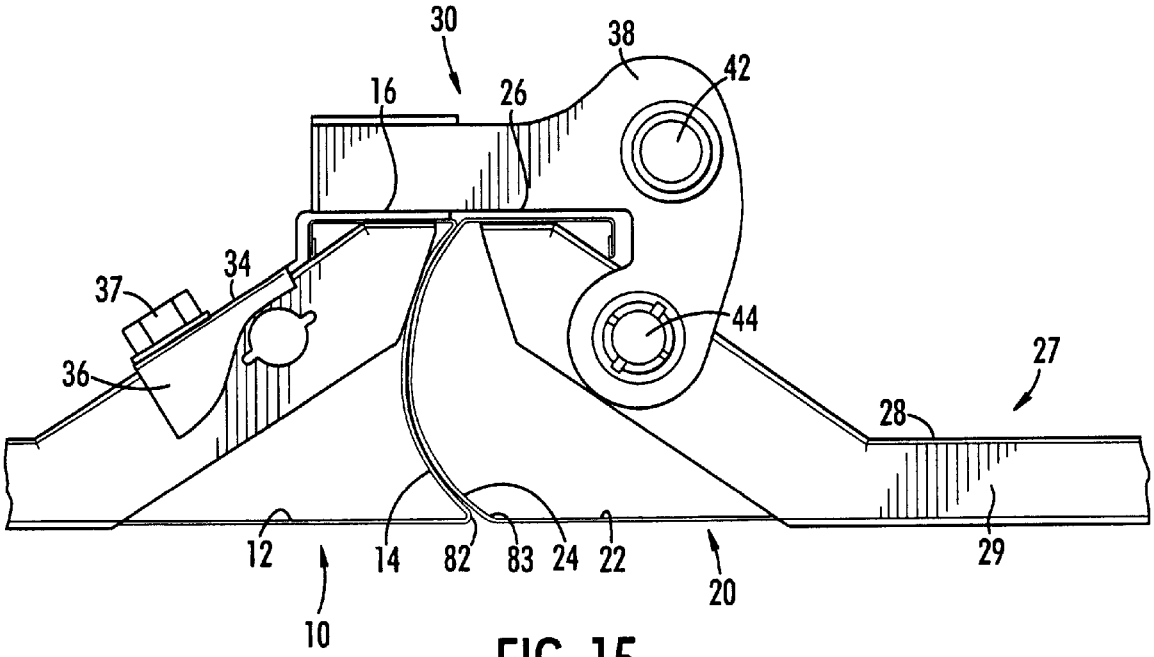
FIG. 15 is a side view of the door panels including the bracket.
Figure 16:
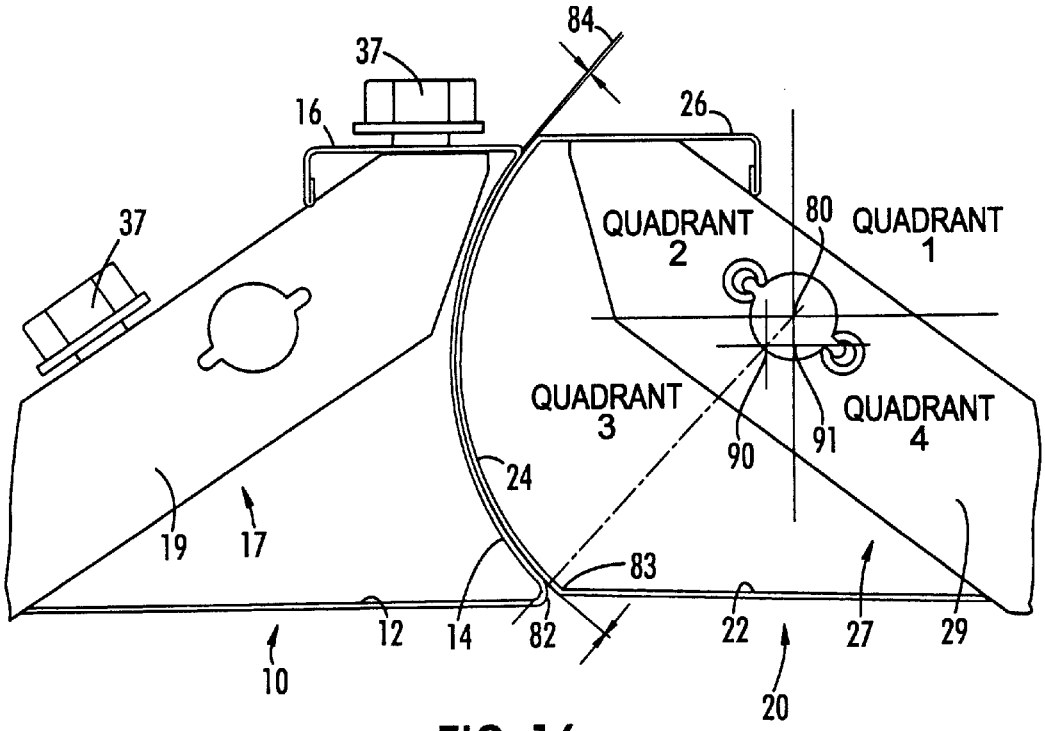
FIG. 16 is a side view of the door panels during backbending.

The analysis of the geometry of the movement and panel structure is best undertaken with the door in its closed position, with the panels in vertical alignment. The reason for this is that the doors are installed in this position with the point of contact 100 being the only contact between the panels. From this position, it is desired that any relative movement between the panels increases the distance between them and, by choosing the rotational center 80 a predetermined distance 96 away from the center of curvature 90, this relationship is accomplished. Further, the location of the rotational center 80 allows the area of contact to be rapidly separated once rotational motion is begun. The side view in FIG. 15 illustrates the panel relationship with the brackets in place. FIG. 16 is similar to FIG. 14 except that the doors are undergoing backbending and it can be seen that the gap 84 between the panels 10,20 is maintained. Some interference may occur at other points adjacent the contact line 100.

As may be expected, the hinge pins 50,70 are reversible and they are self-aligning to the extent that an installer does not have to have sight of the slots for aligning the pins therein and installation may proceed smoothly and rapidly.

Figure 17:
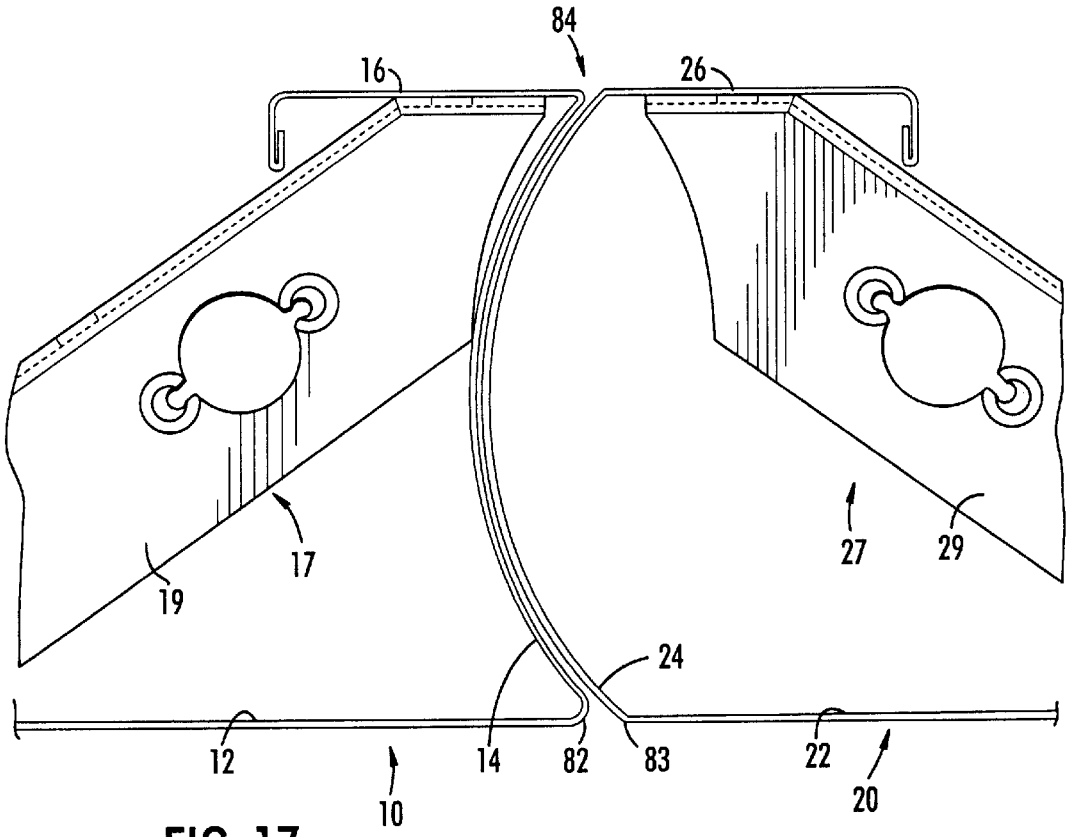
FIG. 17 is a side view of the door panels exaggerating the gap therebetween to illustrate the curvature.

Operational relative panel movement is illustrated in FIGS. 17–20. It should initially be noted that the gap between the panels in FIG. 17 is exaggerated for clarity yet there remains the contact point 100 which, although not illustrated specifically in 17, is known to exist from prior disclosure herein.

Figure 18:
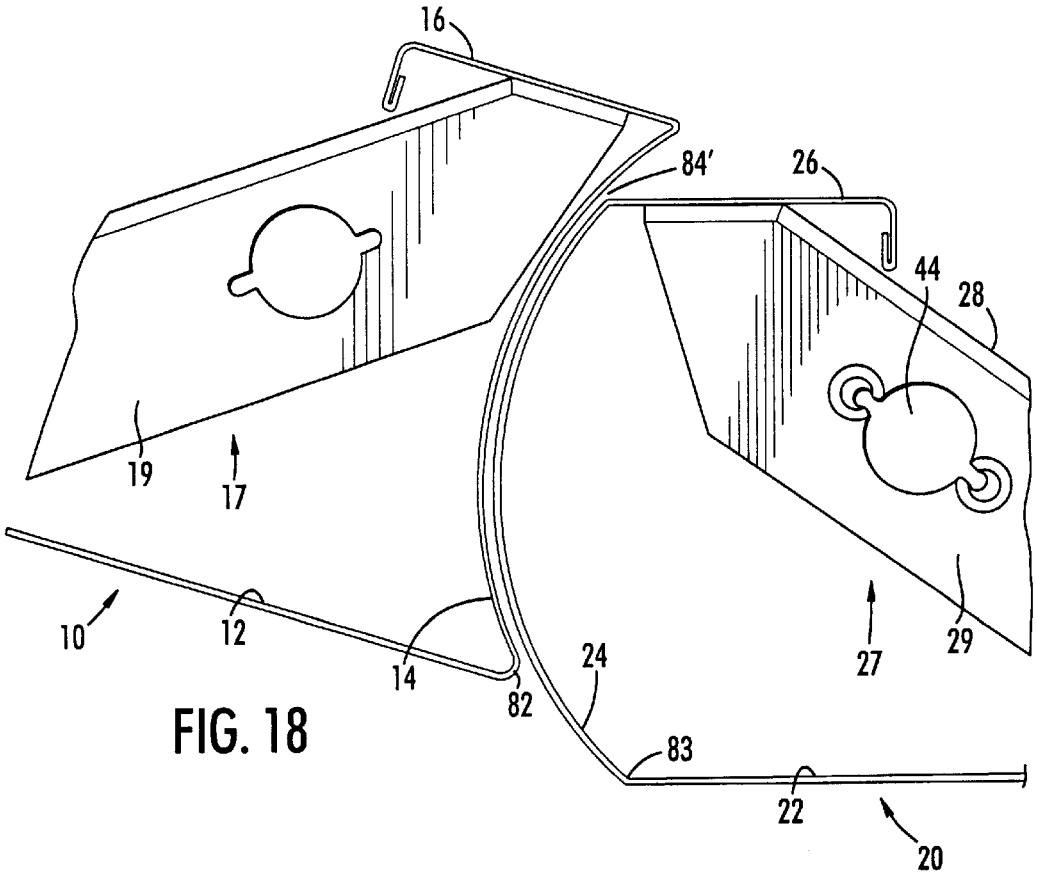
FIG. 18 is a side view of the door panels during operation with the panels at approximately 15° orientation.
Figure 19:
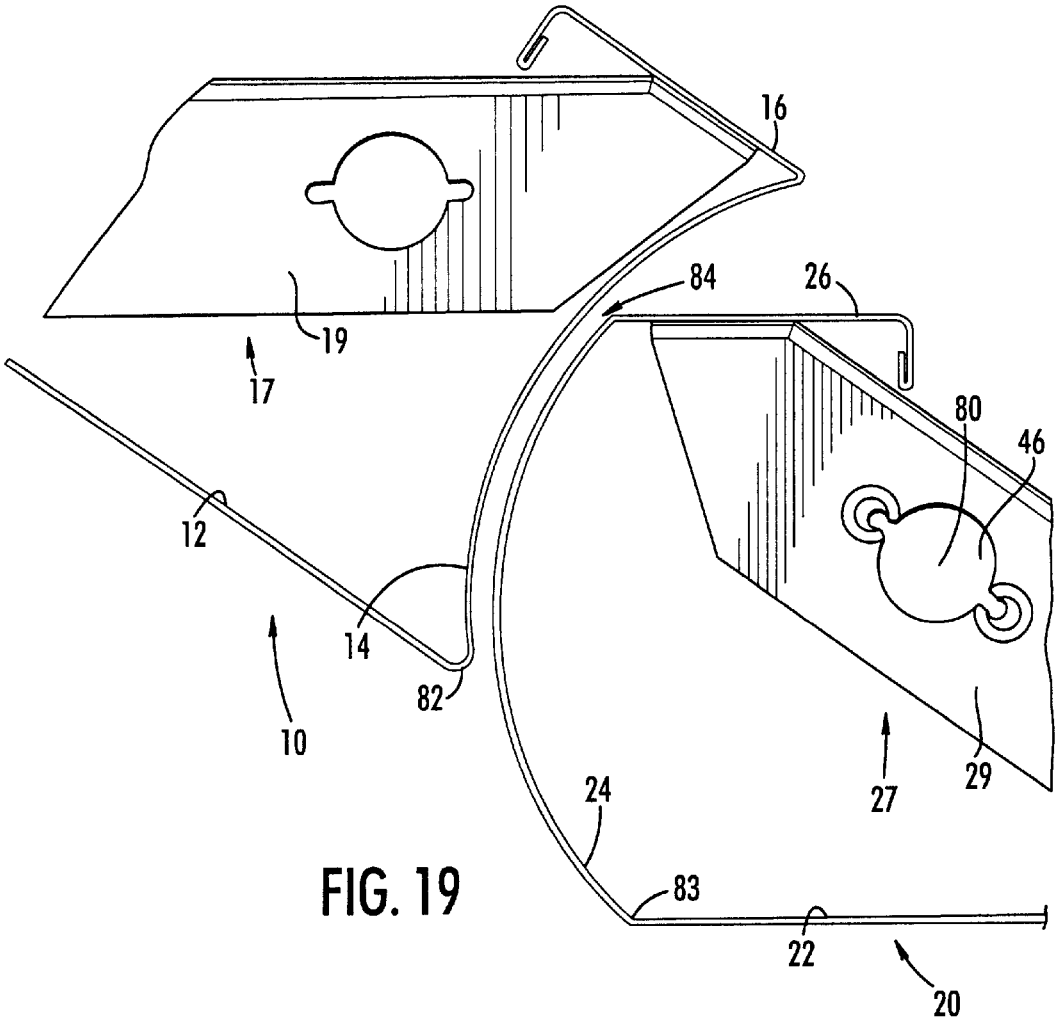
FIG. 19 is a side view of the door panels during operation with the door panels at approximately 30° orientation.

Once the door control is activated, the door begins to lift and the rollers in the track force the panels away from one another through a curve occurring during the transition from vertical to horizontal orientation. In FIG. 18, the panels are at a 15° orientation and it can be seen that the corner 82 remains a minimum distance away from the lower panel 24 while a gap 84' at the inner surface is widening. This effect is enhanced at the 30° inclination as seen in FIG. 19. Finally, at 70°, the gap 84 between the lower surface 24 and the upper outer corner is at a maximum yet remains insufficient to allow pinching of extremities between door panels.

Figure 21:
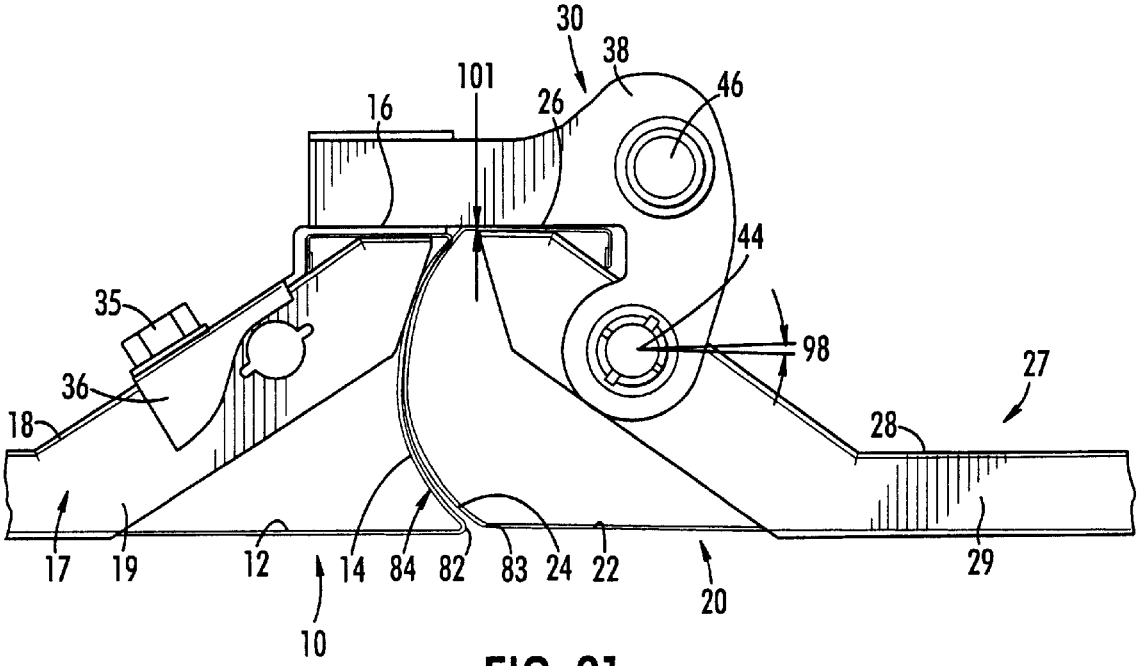
FIG. 21 is a side view of the door panels including the bracket during backbending.
Figure 20:
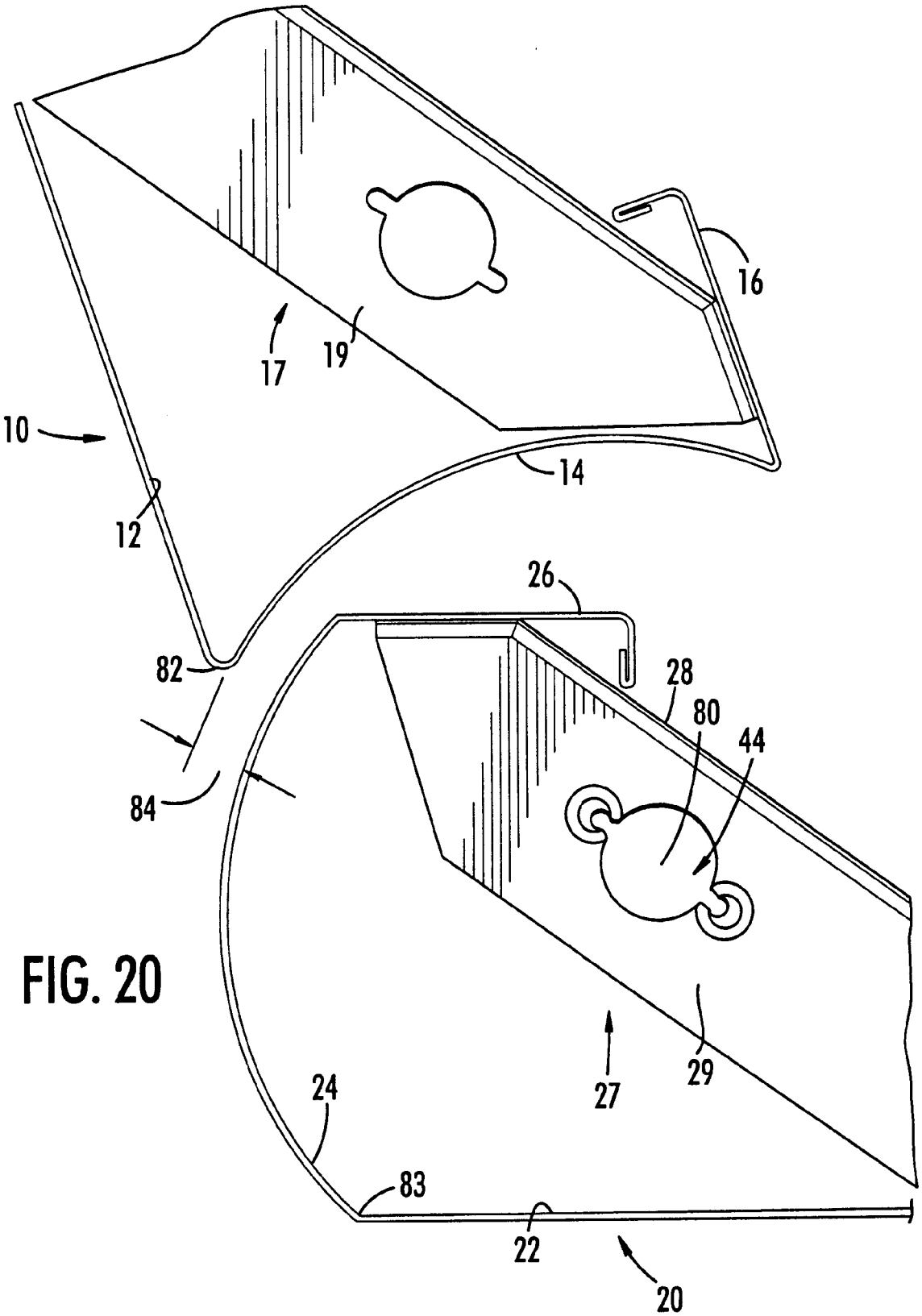
FIG. 20 is a side view of the door panels during operation with the door panels at a maximum 70° orientation.

Finally, once the door is in its horizontal, overhead stored position, the first and second panels, i.e., the uppermost and second uppermost panels when vertically oriented, are in a backbending condition as seen in FIG. 21. This causes the flange 26 on the lower panel 20 to be forced into the bracket 30 at a position illustrated at 101. The backbending is approximately 5° as seen in angle 98. Due to the differential curvature between the upper and lower panel mating surfaces, 5° of backbending is allowed without sufficient binding to cause damage.

By the above, the present invention provides a unique paneled door mating assembly which provides smooth operation and a no-pinch feature while simultaneously allowing ease of assembly and controlled wear surfaces. Further, the simplicity of the concave and convex surfaces is highly desirable compared to other, more complex approaches which consume greater quantities of material. Finally, the present invention allows for the use of lighter materials resulting in less wear on the door's operational components.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

We claim:

1. A multi-panel door assembly comprising:

first and second panels configured for movement along a curved track from a generally vertical position to a generally horizontal position and for pivoting movement relative to one another about a pivot axis, each said panel having a front side forming part of the front of the door assembly and a back side forming part of the back of the door assembly; and a hinge including a base fixedly mounted to said back side of said first panel and including two mounting walls extending therefrom with each said mounting wall having an opening formed therein coincident with said pivot axis;

said second panel having a hinge mounting member mounted to said back side and including two sidewalls each having an aperture formed therein coincident with said pivot axis, said mounting walls extending from said first panel to adjacent said sidewalls; and a hinge pin extending through said openings and said apertures to pivotally mount said first panel to said second panel for pivoting of said first panel about said pivot axis relative to said second panel.

2. A multi-panel door assembly according to claim 1, wherein said hinge pin includes a plurality of tabs projecting outwardly from a cylindrical surface thereof at a predetermined circumferential spacing;

said sidewalls include a first plurality of notches sized and disposed at a predetermined circumferential spacing adjacent said apertures to allow passage of said tabs therethrough, said predetermined circumferential spacing corresponding to said predetermined circumferential spacing of said tabs;

and said mounting walls include a second plurality of notches sized and disposed at a predetermined circumferential spacing adjacent said openings to allow passage of said tabs therethrough, said predetermined circumferential spacing corresponding to said predetermined circumferential spacing of said tabs, said hinge pin thereby passing through said openings and said apertures with said tabs passing through said notches when said first plurality and second plurality of notches are rotationally aligned.

3. A multi-panel door assembly according to claim 2 wherein each said mounting wall includes an annular flange projecting outwardly therefrom about said opening, each said notch in said mounting wall being formed in said annular flange.

4. A multi-panel door assembly according to claim 2 wherein said first plurality and second plurality of notches remain rotationally nonaligned during relative pivoting movement of said first panel relative to said second panel by less than 70° from the generally vertical position.

5. A multi-panel door assembly according to claim 2, wherein said plurality of tabs include a pair of outer tabs disposed adjacent opposed ends of said hinge pin and at least one pair of inner tabs projecting outwardly from said cylindrical surface thereof at a predetermined position along said hinge pin, said outer tabs being intermediate said inner tabs and said ends of said hinge pin; and wherein at least one of said sidewalls is formed with a tab retainer projecting from an inner surface thereof adjacent said aperture thereof, said tab retainer having a slot open to said aperture and sized for receipt and engagement therein with one of said inner tabs when said first and second panels are pivotally mounted together by said hinge pin, whereby rotation of said hinge pin relative to said second panel is prevented during relative pivotal movement between said first and second panels.

6. A multi-panel door assembly according to claim 5 further including a pair of inner tab retainers disposed on opposite sides of each said aperture in each said sidewall, and wherein said hinge pin is formed with two pair of inner tabs, each tab being sized and disposed along said hinge pin for receipt within and engagement therein by one of said tab retainers to prevent rotation of said hinge pin relative to said second panel during relative pivotal movement between said first and second panels.

7. A multi-panel door assembly according to claim 2, wherein said first plurality and second plurality of notches are rotationally aligned when said first panel is pivoted relative to said second panel by approximately 90° from the generally vertical position.

8. A multi-panel door assembly according to claim 1 further including means for retaining said hinge pin extending through said openings and said apertures.

9. A multi-panel door assembly according to claim 8, further comprising means for fixing said hinge pin against rotation relative to said second panel.

10. A multi-panel door assembly according to claim 1 further including means for fixing said hinge pin against rotation relative to said second panel.

11. A multi-panel door assembly according to claim 6, wherein each said second panel includes a stile forming said hinge mounting member; and said hinge consists of a single piece of folded sheet material and includes a pair of J-shaped arm portions in which said openings are formed.

12. A multi-panel door assembly according to claim 11, wherein said hinge includes a double fold.

13. A multi-panel door assembly according to claim 11, wherein each J-shaped arm portion includes a curvature that is greater than the distance between said mounting walls at said base.

14. A multi-panel door assembly according to claim 11, wherein a said J-shaped arm portion includes an opening formed therein for attachment of a track roller.

15. A multi-panel door assembly comprising first and second adjacent panels pivotally mounted to one another for pivoting about a pivot axis and configured for movement along a curved track from a generally vertical position to a generally horizontal position, said first and second panels having adjacent ends that engage one another only along a line of contact that is significantly less than the area of said concave and convex surfaces when in the vertical position, wherein:

said panel end of said first panel at said line of contact has a concave surface with a first radius of curvature about a first center point, said panel end of said second panel at said line of contact has a convex surface with a second radius of curvature that is less than said first radius of curvature and that extends about a second center point different from said first center point, and said first center point and said second center point are not collinear with said pivot axis.

16. A multi-panel door assembly according to claim 15, wherein said second panel includes a front face forming part of the front of the multi-panel door assembly and said front surface joins said convex surface of said second panel at a bend point, said bend point and said first center point lying along a line that perpendicularly intersects said pivot axis.

17. A multi-panel door assembly according to claim 15, wherein said concave surface of said first panel end and said convex surface of said second panel end define a gap therebetween that remains no more than a predetermined maximum distance apart during pivotal movement between said first panel and said second panel, said predetermined maximum distance being sufficiently small to prevent a finger from entering between said first panel end and said second panel end.

18. A multi-panel door assembly according to claim 15, wherein said panel end of said first panel simply consists of a concave surface and said panel end of said second panel simply consists of a convex surface.

19. A multi-panel door assembly according to claim 15, wherein said first and second panels each includes a front surface forming part of the front of the multi-panel door assembly and said first panel is disposed above said second panel when the multi-panel door assembly is in the vertical position, and wherein the closest point along said pivot axis to said first center point lies below said first center point and lies further from said front surface of said second panel than said first center point when said first and second panels are in the vertical position.

20. A multi-panel door assembly according to claim 15, wherein each said panel is formed from sheet material to make a single-skinned non-insulated multi-panel door assembly.

21. A multi-panel door assembly, comprising:

first and second panels configured for movement along a curved track from a generally vertical position to a generally horizontal position and for pivoting movement relative to one another about a pivot axis, said first and second panels having stiles and sheet material shaped and mounted to said stiles to form part of a front face of said door assembly, said sheet material further being shaped to define adjacent ends of said panels that engage one another along a line of contact that is significantly less than the area of said ends when the panels are in vertical position, said panel end of said first panel at said line of contact having a concave surface with a first radius of curvature about a first center point, said panel end of said second panel at said line of contact having a convex surface with a second radius of curvature that is less than said first radius of curvature and that extends about a second center point different from said first center point, said first center point and said second center point not being collinear with said pivot axis;

a hinge including a base fixedly mounted to a said stile of said first panel and two mounting walls extending from said base with each said mounting wall having an opening formed therein coincident with said pivot axis, said mounting walls including a first plurality of notches sized and disposed adjacent said openings, said second panel having a said stile with two sidewalls each having an aperture formed therein coincident with said pivot axis, said sidewalls including a second plurality of notches sized and disposed adjacent said apertures, said mounting walls extending from said first panel to adjacent said sidewalls; and a hinge pin extending through said openings and said apertures to pivotally mount said first panel to said second panel for pivoting of said first panel about said pivot axis relative to said second panel, said hinge pin including a outer tabs disposed adjacent opposed ends of said hinge pin and at least one inner tab projecting outwardly from said cylindrical surface thereof, said hinge pin thereby passing through said openings and said apertures with said tabs passing through said notches only when said first plurality and second plurality of notches are rotationally aligned.

22. A multi-panel door assembly according to claim 21, wherein at least one of said sidewalls is formed with a tab retainer projecting from an inner surface thereof adjacent said aperture thereof, said tab retainer having a slot open to said aperture and sized for receipt and engagement therein with a said inner tab, rotation of said hinge pin relative to said second panel thereby being prevented during relative pivotal movement between said first and second panels.

* * * * *